US006416914B1

(12) United States Patent
Nakamura et al.

(10) Patent No.: US 6,416,914 B1
(45) Date of Patent: Jul. 9, 2002

(54) IMAGE FORMATION PROCESS AND DEVELOPER USED THEREIN

(75) Inventors: Masae Nakamura; Takashi Yamamoto; Masakazu Kinoshita; Yoshimichi Katagiri, all of Kawasaki; Shinichi Kuramoto, Numazu; Hachiro Tosaka, Shizuoka; Hiroshi Yamashita, Numazu; Osamu Uchinokura, Shizuoka, all of (JP)

(73) Assignees: Fujitsu Limited, Kawasaki; Ricoh Company, Ltd., Tokyo, both of (JP)

( * ) Notice: Subject to any disclaimer, the term of this patent is extended or adjusted under 35 U.S.C. 154(b) by 0 days.

(21) Appl. No.: 09/643,910

(22) Filed: Aug. 23, 2000

(30) Foreign Application Priority Data

Aug. 24, 1999 (JP) ..... 11-236413
Nov. 19, 1999 (JP) ..... 11-330247

(51) Int. Cl.[7] ..... G03G 13/02
(52) U.S. Cl. ..... 430/31; 430/110.1; 399/175
(58) Field of Search ..... 430/108.4, 110.1, 430/31; 399/175

(56) References Cited

U.S. PATENT DOCUMENTS 5,633,701 A * 5/1997 Yoshida ..... 399/175
6,183,927 B1 * 2/2001 Magome et al. ..... 430/108.4

* cited by examiner

*Primary Examiner*—John Goodrow
(74) *Attorney, Agent, or Firm*—Armstrong, Westerman & Hattori, LLP

(57) ABSTRACT

An image formation process which forms a toner image by the nonmagnetic one-component developing system by bringing an electrically conducting brush impressed with a voltage into contact with a photosensitive material to effect the uniform charging, and forming an electrostatic latent image on the photosensitive material by the exposure to the image-bearing light, wherein the toner that is used as a circularity of from 0.92 to 0.98. The nonmagnetic one-component developing system minimizes irregular electric charging that stems from the use of the electrically conducting brush. This action is obtained even in full-color developing system which effects development many times.

25 Claims, 4 Drawing Sheets

IMAGE FORMATION PROCESS AND DEVELOPER USED THEREIN

BACKGROUND OF THE INVENTION

1. Field of the Invention

The present invention relates to an image formation process. More specifically, the invention relates to an image formation process in a copier or a printer based on an electrophotographic system. In particular, the invention relates to an image formation process by improving the step of development in the electrophotographing process. If described in further detail, the invention is concerned with a nonmagnetic one-component developing process, using an electric charger employing an electrically conducting brush, featuring excellent image properties such as resolution, gradation, image density and color reproduceability, as well as a developing agent used for the developing process. The invention further deals with a full-color nonmagnetic one-component developing method employing the above-mentioned system and a full-color developing agent used for the developing method.

2. Description of the Related Art

As is well known, an image-forming machine such as an electrophotographic copier, an electrophotographic printer or the like machine, is constituted by an electric charger for imparting a photosensitive property to an electrostatic recording medium, an exposure device for exposing an image carrier (electrostatic recording medium) to image-bearing light to form and record an electrostatic latent-image, a developing device which causes the electrostatic latent image recorded on the image carrier to electrically attract the developing agent to physically visualize the electrostatic latent image, an image transfer device for transferring the visualized image on the image carrier onto a recording medium such as a paper to record the image, and an image-fixing device for heating the image transferred onto the recording medium, to fix the image.

Further, a corona charger utilizing a corona discharge has been extensively used as an electric charger for uniformly charging the image carrier prior to the step of forming an electrostatic latent image on the image carrier. However, the corona charger requires the application of a voltage of as high as several kilovolts for effecting the corona discharge, resulting in an increase in the cost of producing the machine. Besides, ozone generated by the electric discharge damages the parts constituting the device and, particularly, shortens the life of the electrostatic recording medium. Moreover, an offensive odor due to ozone generated by the electric discharge causes discomfort to a person who uses the machine. Furthermore, ozone itself is harmful to human body when its concentration is high and adversely affects the environment.

In order to solve the above-mentioned problem, there has been proposed a so-called electrically conducting brush charger which is a charger which uses an electrically conducting brush as charging means instead of the corona charger. Referring to FIG. 1 which will be referred hereinafter to illustrates the present invention, the electrically conducting brush charger is one in which the electrically conducting brush 2 to which a voltage is applied from a power source 3 is rotated in contact with the image carrier 1 such as the dielectric member to electrically charge it, and is capable of electrically charging the image carrier 1 up to a required potential by applying a voltage of 500 to 1500 volts to the electrically conducting brush 2. Besides, the electrically conducting brush charger is free from the problem of generating ozone. The electrically conducting brush 2 is obtained by implanting brush-like electrically conducting fibers (e.g., rayon fibers) 5 on the periphery of an electrically conducting core rod 6. Further, electrically conducting brush chargers include fixed brush chargers which effect the electric charging using fixed plate-like electrically conducting brushes in addition to those which effect the electric charging while rotating a brush in the shape of a roller, as shown. The fixed brush electric charger can be realized in a small size and at a decreased cost.

However, the charging system using the electrically conducting brush involves defects caused by contamination in the brush-like fiber. That is, the brush-like fiber is in a state of in contact with the image carrier (e.g., photosensitive material drum). When the electrically conducting brush charger is repetitively used for extended periods of time, therefore, fouling on the photosensitive material drum such as residual toner, part of the toner component or paper dust adheres onto, or is adsorbed by, the brush fiber and accumulates. When the fouling exceeds a permissible level, the normal electric charge is reduced. This is because the electrically conducting brush relies upon a local electrical charging mechanism such as aerial discharge in a very small gap relative to the photosensitive material drum. In a portion where the brush fiber is contaminated, fine electric discharge does not take place, and it becomes difficult to realize a uniform and stable electric discharge, causing the electric discharge to occur irregularly. This is further caused by a frictional charge on the brush-like fiber relative to the photosensitive material drum and the injection of an electric charge from the brush-like fiber. In a practical image, the brush fiber produces irregularly swept portions, and background fogging occurs on the irregularly swept portions.

In an image formation process using an ordinary analog system, relatively nonuniform charging (irregular charging) on the photosensitive material drum corresponds to a black portion that is saturation-developed and does not become much of a problem. In a digital system employing reversal development, however, this corresponds to the background portion and could become a cause of background fouling. Besides, an improvement in the particulate property (decrease in the image noise) in a high-light portion (low-density region) which is a viewing point in reproducing natural image, becomes important if high image quality is demanded.

In addition, in the contact charging system using an electrically conducting brush, components and foreign matter contained in the developing agent and in the transfer paper adhere onto the brush causing a change in the latent image potential and developing relatively conspicuous background fouling.

Further, when a nonmagnetic one-component developing system is employed, the irregular charging on the photosensitive material becomes further conspicuous after developing. The reasons will be described hereinbelow.

The nonmagnetic one-component developing method using a nonmagnetic one-component developing agent (hereinafter also referred to as "nonmagnetic toner") can be executed in a manner as described below by using the developing device shown in FIG. 2 which can be used even in the embodiment of the present invention after the constitution has been improved. In the developing device 10, a developing roller 14 is provided in contact, under pressure, with a photosensitive material drum 1 in a toner container 13 installed near the photosensitive material drum 1 and, besides, a toner-replenishing roll 15 is provided in contact with the developing roller 14. The developing roller 14 is supplied with a developing bias from a power source 17. A one-component developing agent 11, which is a nonmagnetic toner, is contained in the toner container 13. Due to the rotation of the toner-replenishing roll 15, the toner 11 supplied onto the surface of the toner-replenishing roll 15 is conveyed to the surface contacting the developing roller 14. The non-magnetic toner 11 is formed in a thin layer, due to a toner layer thickness-limiting blade 16 that is in contact with the developing roller 14, and is conveyed to the photosensitive material drum 1 through the rotation of the developing roller 14. As a result, the electrostatic latent image on the surface of the photosensitive material drum 1 is developed with the nonmagnetic toner conveyed to the photosensitive material drum 1.

According to this developing method, it is important to form a nonmagnetic toner layer having a uniform and small thickness on the developing roller. Therefore, the layer thickness-limiting blade is provided to make uniform the thickness of the nonmagnetic toner layer adhered to the surface of the developing roller.

In this case, the electric charge to the toner varies depending upon the compression and friction between the developing roller and the toner-replenishing roller and between the developing roller and the layer thickness-limiting blade. Therefore, the electric charge on the toner is greatly affected by the surface coarseness of the developing roller. In particular, a very fine image is not reproduced in developing the toner for the latent image that is affected by the irregular electric charge when the electrically conducting brush is used.

Further, when the conventional toner having a nearly amorphous particle shape and a wide particle size distribution is used, a uniform and thin toner layer is not formed between the developing roller and the toner-replenishing roller or between the developing roller and the layer thickness-limiting member. Therefore, a fine half-tone image is not reproduced when developing the toner for a latent image that is affected by irregular electric charge when the electrically conducting brush is used.

Furthermore, the nonmagnetic one-component full-color process which successively executes developing many times and transfers them onto the transfer medium in an overlapped manner, is more strongly affected, and is not capable of forming a very fine full-color image like a printed image.

When the nonmagnetic one-component developing system is employed, the fouling of a brush and the resulting irregular charging stem not only from the electrically conducting brush that is used. The toner used as a developing agent in the image formation process and, particularly, the toner employing the nonmagnetic one-component developing system, is blended with various externally added agents such as inorganic fine particles for controlling the fluidity and charging properties of the toner. Here, the present inventors have discovered that these externally added agents cause fouling of the brush and irregular charging.

The externally added agents having a relatively large particle diameter (usually having a particle diameter of not smaller than 0.1 $\mu$m) used for the nonmagnetic one-component developing agent, work to maintain long-lasting and stable fluidity and electrical charging properties. The reasons will now be described.

As will be understood from the above description of the nonmagnetic one-component developing method with reference to FIG. 2, the toner that is used as the developing agent in many cases receives mechanical pressure during the step of developing. Therefore, the externally added agent adhered to the surfaces of the toner particles is buried in the master toner constituted by a binder resin as a chief component, and the effect of the externally added agent is not exhibited to a sufficient degree. The externally added agent having a relatively large particle diameter is less likely to be buried than the externally added agent having a small particle diameter, and it is expected that long-lasting and stable fluidity and electrical charging properties are obtained.

In the two-component developing method using the carrier and the toner in combination, too, the externally added agent having a large particle diameter works advantageously. This is because the externally added agent forms protrusions which grind a film of spent toner formed on the carrier. The same effect is obtained even for the film formed on the photosensitive material drum. Further, when the toner image is to be transferred from the photosensitive material drum onto a recording medium such as paper, the externally added agent having a large particle diameter works to lower the adhering force of the toner to the photosensitive material drum, from which an improved transfer efficiency can be expected. Thus, the externally added agent having a large particle size in many cases works advantageously in the image formation process.

When the master toner and the externally added agent are mixed together without applying a sufficient degree of physical force, however, the externally added agent having a large particle diameter is simply adhered electrostatically to the master toner particles and can be easily peeled off the toner particles by the application of a physical force or an electric attractive force. It is considered that in the externally added agent having a small particle diameter, the Van der Waals force works dominantly; i.e., the externally added agent that is once adsorbed is less likely to be peeled off. The externally added agent having a large particle diameter, on the other hand, does not exhibit the Van der Waals force and may be liberated. Therefore, the free externally added agent having a large particle diameter induces brush fouling and causes irregular electric charging.

SUMMARY OF THE INVENTION

It is an object of the present invention to provide an image formation process which suppresses irregular electric charging of the electrically conducting brush as much as possible in the nonmagnetic one-component developing system equipped with an electric charger that uses the electrically conducting brush.

Another object of the present invention is to provide a toner for electrostatic charge developing in the nonmagnetic one-component developing method which is less affected by the irregular electric-charge of the electrically conducting brush and an image formation process.

A further object of the present invention is to provide a toner for full-color electrostatic charge developing based on the nonmagnetic one-component developing method that is less affected by the irregular electric charge of the electrically conducting brush despite the development being conducted many times successively and the images are transferred onto the transfer medium in an overlapped manner, and a full-color image formation process.

A still further object of the present invention is to provide an image formation process which suppresses the irregular electric charge as much as possible as a result of suppressing the fouling of the electrically conducting brush yet maintain a long life and high transfer efficiency by using a toner to which is added an externally added agent (external additive)

having a relatively large particle diameter at the time of forming the image by using an image formation apparatus equipped with an electric charger using the electrically conducting brush.

A yet further object of the present invention is to provide a developing agent for electrophotography which is effective in putting the above-mentioned image formation process into practice.

The other objects of the present invention will be appreciated from the description as set forth below with regard to the preferred embodiments thereof.

The present inventors have discovered that a toner having a particular circularity forms a uniform and thin layer on a developer roller in the nonmagnetic one-component developing system and permits the image quality to be less affected by the irregular electric charge caused by the electrically conducting brush, and have arrived at the present invention.

The inventors have further discovered that the latent image written onto the photosensitive material does not make an irregular electrostatic latent image become conspicuous when the dot diameter lies within a particular range and, particularly, a half-tone image can be uniformly reproduced. Usually, the exposure spot is a circular shape or an oval shape. Therefore, the writing dot diameter referred to here stands for a diameter on the short axis thereof. When the diameter of exposure is changed by power modulation, the writing dot diameter stands for a maximum diameter (full dot diameter).

In dealing with the nonmagnetic one-component developing system using the electrically conducting brush, further, the inventors have discovered that a uniform and thin layer of toner is formed as the surface of the developing roller becomes very smooth, and a uniform image with a high resolution is obtained as the toner with the diminished reverse charge is used in the developing.

In dealing with the nonmagnetic one-component developing system using the electrically conducting brush, further, the inventors have discovered that the electric charge is easily introduced from the brush fiber to the toner and the electric charge quickly rises upon the use of an electrically conducting brush of a particular material and a brush fiber having a high density, making it possible to effectively suppress irregular electric charges on the photosensitive material.

In dealing with the nonmagnetic one-component developing system using the electrically conducting brush, further, the inventors have discovered that a proper developing amount is obtained when the toner on the developing roller has a particular amount of electric charge, and there is obtained an image of a suitable density, with little fogging, unaffected by an irregular electric charge on the brush.

In dealing with the nonmagnetic one-component developing system using the electrically conducting brush, further, the inventors have also discovered that a proper developing amount is obtained since the toner on the developing roller possesses a relatively narrow particle size distribution containing fine powders and coarse powders in amounts within a particular range, and there is obtained an image, of a suitable density and of a high resolution, unaffected by irregular electric charge of the brush.

In dealing with the nonmagnetic one-component developing system using the electrically conducting brush, further, the inventors have also discovered that a half-tone image is uniformly reproduced when an image is formed by using a full-color toner having a particular circularity, effecting the developing many times, and successively transferring the image onto the transfer medium.

According to the present invention, therefore, there is provided an image formation process wherein, in forming an electrostatic latent image according to an electrophotographic method and in forming a toner image by visualizing the electrostatic latent image with a developing agent, an electrically conducting brush is used as electric charging means, the brush which is impressed with a voltage is brought into contact with an image carrier to execute uniform electric charging, the electrostatic latent image is formed on the surface of the image carrier by exposure to the image-bearing light, and the toner image is formed by a nonmagnetic one-component developing system using a developing agent of a toner having a circularity within a range of from 0.92 to 0.98.

The present invention further provides a developing agent for electrophotography comprising a toner having a circularity over a range of from 0.92 to 0.98, the developing agent for electrophotography being used in an image formation process which forms the toner image by the nonmagnetic one-component developing system by bringing an electrically conducting brush impressed with a voltage into contact with a photosensitive material to effect uniform charging, and forming an electrostatic latent image on the photosensitive material by exposure to the image-bearing light.

The inventors have further studied the above-mentioned problems, and have discovered that the picture quality is less affected by irregular electric charge caused by the fouled brush as a result of optimizing the condition of the externally added agent added to the toner, and that the picture quality is less affected by irregular electric charge caused by the fouled brush as a result of optimizing the condition of the electrically conducting brush used by the electric charger, and have thus accomplished the present invention.

According to the present invention, therefore, there is provided an image formation process, wherein, in forming an electrostatic latent image according to an electrophotographic method and in forming a toner image by visualizing the electrostatic latent image with a developing agent, an electrically conducting brush is used as electric charging means, the brush which is impressed with a voltage is brought into contact with an image carrier to execute uniform electric charging, the electrostatic latent image is formed on the surface of the image carrier by the exposure to the image-bearing light, and the toner image is formed by using a developing agent of a toner containing at least an externally added agent having an average particle diameter over a range of from 0.1 to 2.0 $\mu$m and a freeing ratio (separation ratio) of not larger than 20%.

The invention further provides a developing agent for electrophotography comprising a toner and containing at least an externally added agent having an average particle diameter over a range of from 0.1 to 2.0 $\mu$m and a freeing ratio of not larger than 20%, the developing agent for electrophotography being used in an image formation process which forms the toner image by a nonmagnetic one-component developing system by bringing an electrically conducting brush impressed with a voltage into contact with a photosensitive material to effect uniform charging, and forming an electrostatic latent image on the photosensitive material by the exposure to image-bearing light.

The invention provides an image formation process improving such defects as background fouling, lack of image density or insufficient reproduction of a very fine image, caused by an irregular electric charge, by the charger using an electrically conducting brush in the nonmagnetic one-component process, compared to the prior art. The invention further provides a toner for high picture quality and a toner for full color adapted to the system.

In forming the image by using the image formation apparatus equipped with the electric charger using the electrically conducting brush of the present invention, further, irregular electric charge is suppressed as much as possible by suppressing the fouling of the electrically conducting brush yet extending the life or maintaining a high transfer efficiency by using a toner to which is added an externally added agent having a relatively large particle diameter, and the background fouling caused by the fouled brush is prevented. The invention further provides a color image formation apparatus of high performance by utilizing such distinguished effects.

BRIEF DESCRIPTION OF THE DRAWINGS

The present invention will be more clearly understood from the description as set forth below with reference to the accompanying drawings, wherein.

DESCRIPTION OF THE PREFERRED EMBODIMENTS

Figure 1:
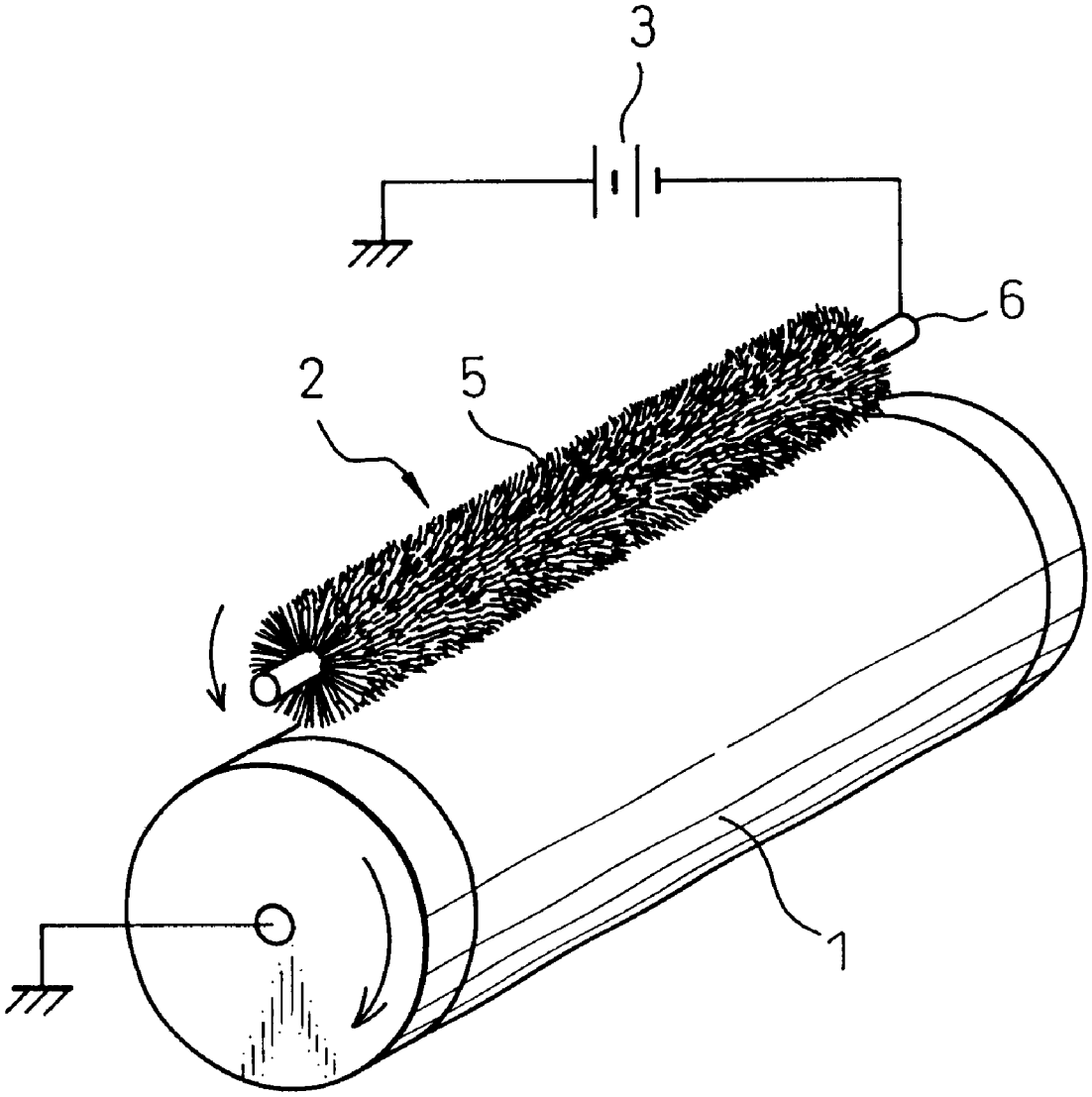
FIG. 1 is a perspective view illustrating an electrically conducting brush charger used in the present invention.

The image formation process according to the present invention and a developing agent used therein can be put into practice in a favorable form as described below in compliance with the electrophotographic process. It should, however, be noted that the present invention is in no way limited to the below-mentioned embodiments but can be modified or improved in a variety of ways without departing from the scope of the invention.

The image formation process according to the present invention is based on an electrophotographic system that forms a toner image by visualizing an electrostatic latent image with a developing agent. In one aspect of the invention, the image formation process:

(1) forms an electrostatic latent image on the surface of an image carrier by using an electrically conducting brush as electric charging means, bringing the brush impressed with a voltage into contact with the image carrier to effect uniform electric charging, and exposing the image carrier to the image-bearing light; and (2) forms a toner image by using a developing agent of a toner containing at least an externally added agent having an average particle diameter in a range of from 0.1 to 2.0 $\mu$m and having a freeing ratio of not larger than 20%.

That is, as described earlier, the process of the present invention is characterized by an improvement in the step of development. One feature resides in the use of an electrically conducting brush charger as an electrical charging means instead of the corona charger, and another feature resides in that an externally added agent having an average particle diameter in a range of from 0.1 to 2.0 $\mu$m and a freeing ratio of not larger than 20% is added to the toner that is used as a developing agent. In forming the image, the image carrier such as the photosensitive material drum is electrically charged by the electrically conducting brush charger, the toner containing the externally added agent having an average particle diameter of from 0.1 to 2.0 $\mu$m is used as a developing agent for visualizing the electrostatic latent image that is formed, and the freeing ratio of the externally added agent is suppressed to be not larger than 20%, so that the picture quality is hardly affected by an irregular electric charge caused by a fouled brush.

The image formation process of the present invention is particularly effectively used for an image formation apparatus such as an electronic photographic copier, an electronic photographic printer and a similar apparatus. Generally, further, the image formation process is carried out through the following series of steps of:

(1) electrically charging the image carrier (electrostatic recording medium) to impart photosensitivity to it;

(2) exposing the image carrier to image-bearing light to form an electrostatic latent image and to record it therein;

(3) developing the electrostatic latent image recorded on the image carrier by having developing agent electrically attracted thereto to physically visualize the electrostatic latent image;

(4) transferring the visualized image on the image carrier onto a recording medium such as paper to record it; and (5) fixing the image transferred onto the recording medium by heating it.

The first charging step starts with providing the image carrier. The image carrier is a constituent element serving as a base of the image formation apparatus and is, typically, a photosensitive material drum. For example, the photosensitive material drum is an aluminum drum, as a core metal, with a mirror finished surface and on which is deposited a layer of photosensitive material. As the photosensitive material, there can be used, for example, selenium, zinc oxide, cadmium sulfide, organic photoconducting material (OPC) or amorphous silicon. Further, the photosensitive material is deposited by, for example, vaporization or coating.

As an electric charger for uniformly charging the image carrier, there can be used an electrically conducting brush charger. In the electrically conducting brush charger, a voltage of 500 to 1500 V is applied to the electrically conducting brush to electrically charge the image carrier to a desired potential as described earlier with reference to FIG. 1. The electrically conducting brush may be used in the form of a rotary electrically conducting roller by winding an electrically conducting fiber (e.g., rayon fiber, polyester fiber, etc.) implanted in a base fabric around an electrically conducting core rod, or may be used in the form of a plate-like (bar-like) brush by bundling and securing the electrically conducting fiber like a brush. In the latter case, the size and cost can be further lowered compared to the former case.

According to the process of the present invention, it is desired that the electrically conducting brush used in the electrically conducting brush charger has an electric resistance over a range of from $1\times10^3$ to $1\times10^7$ Ω. This is because, upon adjusting the electric resistance of the electrically conducting brush to lie over a range of from $1\times10^3$ to $1\times10^7$ Ω, the picture quality is less affected by irregular electric charges caused by the fouled brush.

Thereafter, the image carrier, after being electrically charged, is exposed to image-bearing light to form an electrostatic latent image to record it. The step of exposure to light can be conducted based upon various methods of exposure to light depending upon the step of forming the latent image. Generally, there can be used a semiconductor laser optical system, an LED optical system or a liquid crystal shutter (LCS) optical system as a source of light for exposure.

After the step of exposure to light has been finished, the step of developing, in which the developing agent is electrically attracted by the electrostatic latent image recorded on the image carrier to physically visualize the electrostatic latent image, is conducted. This step, too, can be executed by using various devices as in other steps of the process of the invention. The developing device is typically constituted by a toner container constituted by the casing (toner hopper for containing the developing agent and, preferably, the one-component developing agent), the image carrier (described above) capable of forming and holding the electrostatic latent image, a developing agent carrier capable of conveying the developing agent onto the developing region on the image carrier and disposed in contact with, and opposed to, the image carrier, a developing agent feeding member capable of feeding the developing agent in the toner container onto the developing agent carrier and is disposed to move in elastic contact with the developing agent carrier, and a thickness-limiting member for limiting the thickness of the developing agent on the developing agent carrier fed from the developing agent feeding member, though it may vary depending upon the developing system that is employed.

Here, the developing agent carrier which is capable of conveying the developing agent onto the developing region on the image carrier such as the photosensitive material drum and is disposed in contact with, and opposed to, the image carrier, is, preferably, formed of an electrically conducting member and is, typically, a developing roller, a developing sleeve or the like. For example, the developing roller is formed by using an aluminum roller as a core metal, and applying a resin covering onto the surface thereof. As required, a fiber brush or the like may be implanted on the surface of the roller.

The developing agent feeding member capable of feeding the developing agent in the toner container onto the developing agent carrier and disposed to move in elastic contact with the developing agent carrier, is preferably formed of an electrically conducting member and is, typically, a sponge roller, a fur brush or the like. The sponge roller is formed by using an aluminum roller as a core metal and applying a porous resin covering onto the surface thereof or is constituted substantially entirely by using a sponge material having elasticity, such as an urethane foam.

The thickness-limiting member for limiting the thickness of the developing agent fed from the developing agent feeding member onto the developing agent carrier, is, typically, a thickness-limiting blade or the like. The thickness-limiting blade can be formed in various shapes using various elastic materials in order to uniformalize the thickness of the developing agent adhered in the form a thin film onto the developing agent carrier. The thickness-limiting blade may be made of such a material as elastic rubber, stainless steel plate or leaf spring, which is used after being cut into a shape (e.g., tongue shape, spatula shape, etc.) which is suited for easily removing the toner.

The developing device used for putting the process of the invention into practice may further include, for example, a toner stirrer mechanism, a toner concentration control mechanism, a toner replenishing mechanism and a developing bias control mechanism in addition to the above-mentioned typical constituent elements. These mechanisms are well-known among people skilled in the art, and are not described here in detail.

The electrostatic latent image on the image carrier is visualized to form a toner image which is, then, electrostatically transferred onto the recording medium such as a recording paper and is recorded. The electrostatic transfer method may be, for example, a corona transfer method, a roller transfer method or a belt transfer method.

Thereafter, the image transferred onto the recording medium is heated and fixed. The step of fixing the image can be conducted by using various heating means. As a suitable fixing method, there can be exemplified a hot roll fixing method, a flash fixing method or an oven fixing method.

In carrying out the image formation process of the present invention, there can be used known devices necessary for conducting the electrophotographic process, such as a cleaning device, a charge-removing device, etc. in addition to the above-mentioned various devices. These devices are well known among people skilled in the art and are not described here in detail.

There is no particular limitation on the developing agent that is used in the process of the invention for visualizing the electrostatic latent image. Preferably, however, the developing agent is a nonmagnetic one-component developing agent. The present inventors have discovered that the actions and effects specific to the invention can be exhibited to a satisfactory degree when such a particular developing agent is used. Besides, the nonmagnetic one-component developing agent does not require the use of a carrier, eliminating the use of a device for mixing and stirring the toner and making it possible to decrease the size of the developing device, which is desirable. In the case of this developing agent, further, no magnetic material needs be mixed, which makes it possible to maintain a high transparency and to decrease the thickness of the toner film, exhibiting effect in forming a full-color image. The one-component developing agent may basically have the same composition as the generally used one-component developing agent with the exception of specifying the conditions of the externally added agent and can, hence, be prepared according to the customarily employed method. A preferred method of preparing the developing agent (toner) of the invention will now be described.

The binder resin which is a principal agent of the one-component developing agent (hereinafter also referred to as "developing agent" or "toner") includes various resin materials. Though not limited to those listed below, preferred examples of the binder resin include styrenes such as polystyrene, poly-p-chlorostyrene, polyvinyl toluene and polymers of substituents thereof; styrene copolymers such as styrene-p-chlorostyrene copolymer, styrene-propylene copolymer, styrene-vinyl toluene copolymer, styrene-vinyl naphthalene copolymer, styrene-methyl acrylate copolymer, styrene-ethyl acrylate copolymer, styrene-butyl acrylate copolymer, styrene-octyl acrylate copolymer, styrene-methyl methacrylate copolymer, styrene-ethyl methacrylate copolymer, styrene-butyl methacrylate copolymer, styrene-a-methyl chloromethacrylate copolymer, styrene-acrylonitrile copolymer, styrene-vinyl methyl ketone copolymer, styrene-butadiene copolymer, styrene-isoprene copolymer, styrene-acrylonitrile-indene copolymer, styrene-maleic acid copolymer, and styrene-maleic ester copolymer; polymethyl methacrylate, polybutyl methacrylate, polyvinyl chloride, polyvinyl acetate, polyethylene, polypropylene, polyester, epoxy resin, epoxy polyol resin, polyurethane, polyamide, polyvinyl butyral, polyacrylic acid resin, rosin, modified rosin, terpin resin, aliphatic or alicyclic hydrocarbon resin, aromatic petroleum resin, chlorinated paraffin and paraffin wax. These binder resins may be used alone or as a mixture of two or more kinds.

A coloring agent can be also used as a developing agent component. As the coloring agent, there can be used any known dye and pigment that is usually used for a developing agent. Suitable examples of the coloring agent include carbon black, Nigrosine dye, iron black, naphthol yellow S, Hansa Yellow (10G, 5G, G), cadmium yellow, yellow iron oxide, loess, chrome yellow, Titanium Yellow, polyazo yellow, oil yellow, Hansa Yellow (GR, A, RN, R), pigment yellow L, benzidine yellow (G, GR), Tartrazine Yellow Lake, Quinoline Yellow Lake, anthrazan yellow BGL, isoindolinone yellow, red iron oxide, red lead, scarlet lead, cadmium red, cadmium mercury red, antimony red, permanent red 4R, Para Red, Fire Red, parachloroorthonitroaniline red, Lithol Fast Scarlet G, Brilliant Fast Scarlet, Brilliant Carmine BS, permanent red (F2R, F4R, FRL, FRLL, F4RH), Fast Scarlet VD, Vulcan Fast Rubine B, Brilliant Scarlet G, Lithol Rubine GX, permanent red F5R, Brilliant Carmine 6B, pigment scarlet 3B, Bordeaux 5B, toluidine maroon, permanent Bordeaux F2K, Helio Bordeaux BL, Bordeaux 10B, BON Maroon Light, BON Maroon Medium, eosine lake, Rhodamine Lake B, Rhodamine Lake Y, Alizarine Lake, Thioindigo red B, Thioindigo maroon, oil red, quinacridone red, Pyrazolone Red, polyazo red, chrome vermilion, benzidine orange, orange, oil orange, cobalt blue, cerulean blue, alkaline blue lake, Peacock Blue Lake, Victoria Blue Lake, metal-free phthalocyanine blue, phthalocyanine blue, fast sky blue, indanthrene blue (RS, BC), indigo, ultramarine, prussian blue, anthraquinone blue, fast violet B, methyl violet lake, cobalt violet, manganese violet, dioxane violet, anthraquinone violet, chrome green, zinc green, chromium oxide, viridian, emerald green, pigment green B, naphthol green B, green gold, acid green lake, Malachite Green Lake, phthalocyanine green, anthraquinone green, titanium oxide, zinc flower, lithopone and the like. These coloring agents may be used singly or as a mixture of two or more. The coloring agent can be used in an amount over a wide range depending upon the kind of the developing agent to which it is added and the desired effect. Generally, however, the coloring agent is used in an amount of from 0.1 to 50 parts by weight per 100 parts by weight of the binder resin.

As required, the developing agent of the present invention may contain an electric charge control agent. Any compound that is usually used for the developing agent can be used as the charge control agent. Though not necessarily limited to those listed below, preferred examples of the charge control agent include Nigrosine dye, triphenylmethane dye, chrome-containing metal complex dye, molybdic acid chelate pigment, rhodamine dye, alkoxylamine, quarternary ammonium salt (inclusive of fluorine-modified quarternary ammonium salt), alkylamide, phosphorus alone or a compound thereof, tungsten alone or a compound thereof, a fluorine-containing activating agent, a metal salt of salicylic acid, and a metal salt of salicylic acid derivative. Concretely speaking, these charge control agents are high molecular compounds having functional groups, such as "Bontron 03" which is a Nigrosine dye, "Bontron P-51" which is a quarternary ammonium salt, "Bontron S-34" which is a metal-containing azo dye, "E-82" which is a metal complex of oxynaphthoic acid, "E-84" which is a metal complex of salicylic acid, "E-89" which is a phenolic condensation product (which are products manufactured by Orient Kagaku Kogyo Co.), "TP-302" and "TP-415" which are molybdenum complexes of quarternary ammonium salt (products manufactured by Hodogaya Kagaku Kogyo Co.), "Copy-Charge SPY VP2038" which is a quarternary ammonium salt, "Copy Blue PR" which is a triphenyl methane derivative, "Copy-Charge NEG VP2036" which is a quarternary ammonium salt, and "Copy-Charge NX, VP43" (products manufactured by Hoechst Co.), "LRA-901" and "LR-147" which are boron complexes (products manufactured by Nihon Carlit Co.), copper phthalocyanine pigment, perylene pigment, quinacrydone pigment, azo pigment, as well as other sulfonic acid groups, carboxyl groups and quarternary ammonium salts. These charge control agents may be used alone or as a mixture of two or more kinds.

The amount of the charge control agent in the developing agent is determined depending upon the kind of the binder resin, presence of the additives that are used as required, and the method of producing the toner inclusive of the dispersion method, and is not exclusively determined. Preferably, however, the charge control agent is used in an amount over a range of from 0.1 to 10 parts by weight per 100 parts by weight of the binder resin. More preferably, the charge control agent is used in an amount of from 2 to 5 parts by weight. When the amount of the charge control agent exceeds 10 parts by weight, the electrically charging property of the obtained toner becomes so great that the main charge control agent exhibits a decreased effect, whereby an increased electrostatic attractive force is produced relative to the developing roller, resulting in a decrease in the fluidity of the developing agent and a decrease in the image density.

It is preferred that the developing agent used in the present invention contains wax to impart a parting property to the developing agent. Wax that is suited for imparting the parting property has a melting point over a range of from 40 to 120° C. and particularly, from 50 to 110° C. When the melting point of the wax is too high, the fixing property may become insufficient at low temperatures. When the melting point is too low, on the other hand, resistance against the offset and durability may often decrease. The melting point of the wax can be found by the differential scanning calorimetric (DSC) method. That is, a peak melting value when several milligrams of a sample are heated at a predetermined temperature-elevating rate, for example, at 10° C./min., is regarded to be a melting point.

Though not necessarily limited to those listed below, the waxes that can be used for the developing agent of the present invention are, for example, solid paraffin wax, microwax, rice wax, fatty acid amide wax, fatty acid wax, aliphatic monoketones, fatty acid metal salt wax, fatty acid ester wax, partly saponified fatty acid ester wax, silicone varnish, higher alcohols and carnauba wax. There can be further used polyolefins such as low molecular polyethylene and polypropylene as waxes. In particular, it is desired to use a polyolefin wax having a softening point (as measured by the ring and ball method) over a range of from 70 to 150° C. and, more particularly, to use a polyolefin wax having a softening point over a range of from 120 to 150° C. These waxes may be used singly or as a mixture of two or more.

It is essential that the developing agent used in the present invention contains at least an externally added agent having an average particle diameter in a range of from 0.1 to 2.0 $\mu$m and a freeing ratio of not larger than 20%.

It is desired that the externally added agent has a freeing ratio of not larger than 40% as measured after the developing portion, for forming the toner by using the developing agent, is operated with no load for 20 hours. This is because upon setting the freeing ratio after the developing portion is operated with no load for 20 hours, to be not larger than 40%, the picture quality is little affected by irregular electric charge that is caused by the fouled brush. Note, "no load" used herein means that no electrostatic image is formed on a photosensitive drum to attain a printing factor of 0%, that is, the developing portion is continuously operated without application of the toner for 20 hours.

It is further desired that the externally added agent has a polarity different from the polarity of the mother toner particles constituting the developing agent. With the polarity of the externally added agent being different from the polarity of the mother toner particles, the picture quality becomes less affected by the irregular electric charge caused by a fouled brush.

As for the externally added agents added to the toner, further, it is desired that at least one kind of the externally added agent has an average particle diameter which is not smaller than 1/40 times of the average toner particle diameter. Upon selecting the particle diameter of the externally added agent added to the toner, the picture quality becomes less affected by irregular electric charge caused by the fouled brush.

As the externally added agent that satisfies the above-mentioned requirements, there can be preferably used inorganic fine particles. It is desired that the inorganic fine particles have a primary particle diameter of usually from 0.005 to 2 $\mu$m and, particularly, from 0.005 to 0.5 $\mu$m. It is desired that the specific surface area of the inorganic fine particles is in a range of from 20 to 500 $m^2/g$ as measured by the BET method. It is desired that the ratio of the inorganic fine particles is from 0.01 to 5.0% by weight and, more preferably, from 0.01 to 2.0% by weight per the whole amount of the toner. Concrete examples of the inorganic fine particles include silica, alumina, titanium oxide, barium titanate, magnesium titanate, calcium titanate, strontium titanate, zinc oxide, tin oxide, silica sand, clay, mica, wollastonite, diatomaceous earth, chromium oxide, cerium oxide, red iron oxide, antimony trioxide, magnesium oxide, zirconium oxide, barium sulfate, barium carbonate, calcium carbonate, silicon carbide and silicon nitride.

Preferred examples of the externally added agent include high molecular fine particles such as polymer particles of polystyrene obtained by the soap-free emulsion polymerization, suspension polymerization or dispersion polymerization, methacrylic acid ester or acrylic acid ester copolymer, or of polycondensed resin or thermosetting resin such as silicone, benzoguanamine or nylon.

The externally added agent may further contain a fluidizing agent (or a surfactant). The surfactant treats the surfaces of the toner to improve a hydrophobic property, and prevents a drop in the fluidizing property and charging property even under very humid conditions. Preferred examples of the surfactant include a silane coupling agent, a silylating agent, a silane coupling agent having a fluorinated alkyl group, an organotitanate coupling agent and an aluminum coupling agent.

A cleaning property-improving agent can also be effectively used as an externally added agent. The cleaning property-improving agent works to remove the developing agent that remains on the photosensitive material drum and on the primary transfer medium after the transfer operation, i.e., works to improve the cleaning property. As the preferred cleaning property-improving agent, there can be exemplified metal salts of fatty acids such as zinc stearate, calcium stearate and sodium stearate, and fine polymer particles produced by the soap-free emulsion polymerization of fine polymethyl methacrylate particles and fine polystyrene particles. It is desired that the fine polymer particles used as the cleaning property-improving agent have a relatively narrow particle diameter distribution and have a volume average particle diameter in a range of from 0.01 to 1 $\mu$m.

According to another aspect of the present invention, there is provided an image formation process for forming a toner image by the nonmagnetic one-component developing system by uniformly charging the photosensitive material while bringing an electrically conducting brush impressed with a voltage into contact therewith to form an electrostatic latent image by exposing the photosensitive material to light, wherein the toner that is used has a circularity of from 0.92 to 0.98. This image formation process will now be described in detail though it may partly overlap the foregoing description.

(Electrically conducting brush charger)

The electrically conducting brush chargers may be classified into those of the type which effects the electric charging by rotating a roller-like brush and those of the stationary brush type which effects the electric charging by using a fixed plate-like electrically conducting brush. The electric charger of the stationary type can be realized in a small size and at a decreased price. Described here is a roller-like electrically conducting brush charger capable of effecting the charging more uniformly.

FIG. 1 illustrates an electrically conducting brush charger using a rotary brush that is used in the present invention. The rotary brush used in the present invention will now be described. An electrically conducting brush 2 is obtained by winding a brush-like electrically conducting fiber 5 that is pile-woven around an electrically conducting core 6 which is a stainless steel rod having a diameter of 5 mm, cutting the fiber length to 6 mm, and laying the ends of the fiber so as to have a diameter of 15 mm. The electrically conducting fiber 5 is imparted with electrically conducting property by uniformly dispersing the carbon particles in the rayon fiber, and the fiber has a size of from 400 to 800 deniers/100 F and, preferably, 600 deniers/100 F, the fiber density on the base cloth being from 50,000 to 150,000 and preferably 100,000 $F/in^2$, which are the weight per 100 filaments and the number of filaments per square inch. The electric resistance of the rotary brush is adjusted to be from: $1\times10^3$ to $1\times10^7$ Ω and, preferably, from $1\times10^4$ to $1\times10^6$ Ω when a DC voltage of 100 V is applied. The positional relationship between the rotary brush 2 and the image carrier is such that the electrically conducting core 6 is in parallel with the image carrier, and the rotary brush comes into contact with the surface of the recording medium 1 with a contacting depth of about 1.0 mm.

To record the image, the image carrier 1 is rotated at a predetermined peripheral speed, and the rotary brush 2 is rotated at a peripheral speed which is 1.6 times as fast as the image carrier 1. A voltage is applied from a power source 3 to the electrically conducting brush 2 that is rotating. Then, the surface of the image carrier is charged to a predetermined potential. Here, the power source 3 has a voltage obtained by overlapping an AC component and a DC component, i.e., DC=−650 V, ACp-p=1100 V, and there is obtained a photosensitive material charging potential −650 V needed for the recording processing.

(Writing of latent image)

An electrostatic latent image is formed by exposure to image-bearing light using a laser exposure system or an LED, and a visible image is formed by developing the latent image using a developer. In the present invention, the electric charge tends to become more irregular, by using the electrically conducting brush, when a digital latent image is formed by reversal development than when a continuous analog latent image is formed. That is, the irregular potential due to the brush stems from nonuniform electric charge passing through the ends of the fiber, and exists in a locally dispersed state. The irregular potential corresponds to a black portion in the analog exposure and is not conspicuous due to saturated developing. In the reversal developing, however, this corresponds to a background portion and becomes a cause of background fouling. In particular, this appears conspicuously when the writing dot diameter is larger than a predetermined diameter. Therefore, the writing dot is preferably given in a range of from 10 to 60 $\mu$m. When the writing dot diameter is smaller than 10 $\mu$m, the resolution exceeds one that can be realized with dry developing agent particles of, usually, from 6 to 10 $\mu$m, and no meaningfull improvement in the image quality is obtained even by selecting such a fine dot diameter.

The writing dot diameter referred to here stands for a diameter of a short axis, since the exposure spot is usually of a circular shape or of an oval shape. When the exposure diameter is changed by power modulation or the like, the writing dot diameter then stands for a maximum diameter (full-dot diameter).

(Developing roller)

The material of the developing roller used for the non-magnetic one-component developing method of the present invention may be a metal such as aluminum, steel, SUS, etc. without having an elastic layer. The surface may include those having a surface coarseness obtained by such a working method as sand blasting as will be described later. The material of an elastic layer will be, for example, a natural rubber, a silicone rubber, an urethane rubber, a butadiene rubber, a chloroprene rubber, a neoprene rubber, an isoprene rubber or an NBR. An effective elastic layer is formed by using a rubber, a foamed material or a sponge. It may be effective if the material of the elastic layer is changed depending upon the portions of the developing roller, to which, however, the invention is in no way limited.

It is also possible to provide a magnetic field-generating layer, and the magnetic field intensity may be changed depending upon the portions of the developing roller. The developing roller may be provided with a toner feeding roller for feeding the toner. These two rollers may be in contact or may not be in contact with each other. Further, an AC or DC electric field, or an AC+DC electric field may be applied across the two rollers. Upon providing the toner feeding roller, it is possible to evenly charge the toner and to eliminate dispersion in the toner layer on the developing roller. There is no particular limitation on the material of the toner feeding roller, and any known material can be used such as sponge, rubber, SUS or those which are coated. Depending upon the cases, furthermore, there may be provided, in addition to the feeding roller, a peeling roller that works to peel the toner that has not participated in the developing off the developing roller. There may be further included electrically conducting spherical particles having inorganic fine powder which is adhered or secured to the surfaces of the particles. A coated layer containing a parting component may further be formed.

As the coating resin, there can be used a generally known resin such as phenol resin, epoxy resin, polyamide resin, acrylic resin, polyester resin, silicone resin, fluorine-contained resin, styrene resin, melamine resin and polyimide resin. It is also possible to use the coating resin together with other fine particles, such as furnace black, lamp black, thermal black, acetylene black, channel black, titanium oxide, tin oxide, zinc oxide, aluminum oxide or graphite, which may be used as one kind or in a mixture.

It is also possible to provide blades on the upstream side and on the downstream side of the developing roller relative to the developing position. It is further possible to apply a voltage to these members. The feeding roller may also work to peel off and feed the toner. It is desireable to provide a toner layer-limiting member on the upstream side of the developing portion. The toner layer-limiting member may be of a plate shape or may be a rotary roller. The electric charge may be applied to the toner by the toner layer-limiting member.

The developing system used in the present invention may be a contact-type developing system in which the developing roller and the electrostatic charge-holding member contact to each other, or may be a non-contact-type charging system in which they do not contact to each other, without any particular limitation.

In the present invention, it is desired that the developing roll has a surface coarseness of not larger than 20 $\mu$m. The surface property of the developing roll largely determines the charging property and a uniform and thin layer of the toner sandwiched by the above-mentioned toner layer-limiting member or the feeding roller. Therefore, the charging method using the electrically conducting brush of the invention is particularly effective in forming a very fine image. The surface coarseness is measured by relying upon the ten point average coarseness Rz specified under JIS (Japanese Industrial Standard) B0601. The surface coarseness Rz is measured by using a contact surface coarseness meter SE-40D (manufactured by Kosaka Kenkyujo Co.).

(Circularity of Toner)

It is important that the toner of the invention has a particular shape. The shape of the toner largely determines the charging property and the uniform and thin layer of toner sandwiched between the above-mentioned developing roller and the toner layer-limiting member or the feeding roller. When the toner has an indefinite shape far from a spherical shape, the toner layer becomes too thin and a sufficient amount of developing is not obtained. When the toner shape is too close to the spherical shape, the toner easily passes through the layer-limiting member and the feeding roller, and the developing is effected excessively. In the charging method using the electrically conducting brush according to the present invention, therefore, it is desired that the toner has a particular shape to form a very fine image maintaining proper density. The shape of the toner can be suitably measured by a optical detection method comprising passing a suspension containing toner particles through a detection site of an imaging unit on a flat plate, and optically detecting and.analyzing the image of toner particles using a CCD camera. It was found that the toner having a circularity—which is a value obtained by dividing a circumferential length of a corresponding circle having an equal projection area obtained by the above method by the circumferential length of a real particle—of from 0.92 to 0.98, is effective in forming a very fine image having proper density. This value can be measured as an average circularity by using a flow-type particle image analyzer FPIA-1000 (manufactured by Toa Iyo Denshi Co.). As a concrete measuring method, a surfactant and, preferably, an alkylbenzene sulfonate is added as a dispersant in an amount of 0.1 to 0.5 ml to 100 to 150 ml of water in a container from which solid impurities have been removed in advance and, then, a sample to be measured is added in an amount of from about 0.1 to 0.5 g. The suspension in which the sample is dispersed is dispersed by an ultrasonic dispersing machine for about 1 to 3 minutes such that the dispersant has a concentration of 3,000 to 10,000 particles/$\mu$l, and the toner shape is measured by using the above-mentioned device.

(Particle diameter distribution of the toner)

The average particle diameter and the particle diameter distribution of the toner can be measured by various methods using Coultar counter TA-II or Coultar multisizer (manufactured by Coulter Co.). In this invention, the Coultar counter TA-II (manufactured by Coultar Co.) that is used is connected to an interface (manufactured by Nikkaki Co.) that outputs the particle number distribution and the volume distribution, and is connected to a personal computer PC 9801 (manufactured by NEC Co.). As an electrolyte, a 1% NaCl aqueous solution is prepared by using a class 1 sodium chloride. There can be further used ISOTON-II (manufactured by Coultar Scientific Japan Co.). To take the measurement, a surfactant and, preferably an alkylbenzene sulfonate is added as a dispersant in an amount of 0.1 to 5 ml to 100 to 150 ml of the electrolytic aqueous solution, and to which a sample to be measured is added in an amount of 2 to 20 mg. The electrolytic solution in which the sample is suspended is dispersed by using an ultrasonic dispersing machine for about 1 to 3 minutes, and is measured for its volume and number of toner particles of not smaller than 2 $\mu$m by using the Counter TA-II with an aperture of 100 $\mu$m, in order to calculate the volume distribution and number distribution. Then, a volume-based volume average particle diameter is found from the volume distribution, weight-based coarse powder amount (not smaller than 12.7 $\mu$m) is found from the volume distribution, and the number-based fine powder amount (not larger than 5 $\mu$m) is found from the number distribution.

According to the present invention, it was found satisfactory image density is not obtained.

(Materials constituting the toner)

As for the method and material for producing the developing agent used in the invention, any known one can be employed. The binder resin, coloring agent, charge control agent, wax and externally added agent which are the materials constituting the toner, were described above in detail.

(Preparation of the toner)

The method of preparing the toner of the invention comprises a step of mechanically mixing at least a binder resin, a charge control agent and a developing agent component containing a pigment, a step of melting and kneading them together, a step of pulverization, and a step of classification. The method may further re-use, in the step of mechanical mixing or in the step of melt-kneading, the powder other than the particles from which the product is obtained through the step of pulverization or classification.

The powder other than the particles that are the product referred to here, i.e. by-product, stands for fine particles and coarse particles other than the components from which a product of a desired particle diameter is obtained, the fine particles and coarse particles being formed in the step of melt-kneading, in the step of pulverization and in the subsequent step of classification. It is desired to mix the by-product at a weight ratio of from "by-product" 1/"starting materials" 99 to "by-product" 50/"starting material" 50 in the step of mixing or in the step of melt-kneading.

The step of mixing at least the binder resin, charge control agent, pigment and developing agent component inclusive of by-product may be conducted under ordinary condition using an ordinary mixer made up of rotary vanes without any particular limitation.

After the mixing step has finished, the mixture is fed into a kneader and is melt-kneaded. The melt-kneader that the toner having a volume average particle diameter of from 6 to 10 $\mu$m and containing particles of diameters of larger than 12.7 $\mu$m in a volume-based amount of not larger than 1.0%, is effective in forming a very fine image without developing white stripes and without being affected by irregular electric charge caused by the electrically conducting charging brush.

According to the present invention, further, it was found that the toner having a volume average particle diameter of from 6 to 10 $\mu$m and containing particles of diameters of smaller than 5 $\mu$m in a number-based amount of not larger than 15%, is effective in forming a highly fine image without developing white stripes and without causing defective characters due to diffuse fine powders of toner and without being affected by irregular electric charge caused by the electrically conducting charging brush.

(Amount of electric charge on the developing roller)

Operation of the device was halted while a solid image was being developed, the developing agent adhered on the developing roller was sucked under a reduced pressure and was captured by a filter, and the amount of electric charge possessed by the toner was measured by using a Q-meter to find the ratio to the weight of the developing agent that was sucked. In the present invention, it was found that the toner having an amount of electric charge of 15 to 40 $\mu$C/g is effective in forming a highly fine image that is little affected by irregular electric charge caused by the electrically conducting brush. When the amount of electric charge on the developing roller is smaller than 10 $\mu$C/g in absolute value, fogging becomes conspicuous. When the amount of electric charge on the developing roller becomes not smaller than 40 $\mu$C/g in absolute value, on the other hand, the developing amount becomes insufficient and a may be a monoaxial or biaxial continuous kneader or a batchwise kneader using a rolling mill.

It is important to conduct the melt-kneading under proper conditions so will not to cut the molecular chains of the binder resin. Concretely speaking, the melt-kneading should be conducted at a temperature by taking a softening point of the binder into consideration. When the temperature is much lower than the softening point, the molecular chains are cut to a great extent. When the temperature is very higher than the softening point, the dispersion does not proceed.

After the step of melt-kneading has finished, the mixture is then pulverized. In the step of pulverization, the kneaded product is, first, coarsely pulverized and is, then, finely pulverized. In this case, there is desirably employed a system in which the kneaded product is brought into collision with a collision board by utilizing a jet stream or a system in which the kneaded product is pulverized in a narrow gap between the mechanically rotating rotor and the stator.

After the step of pulverization has finished, the pulverized product is classified in a stream utilizing centrifugal force to thereby obtain a developing agent having a predetermined particle diameter, e.g., having an average particle diameter of from 5 to 20 $\mu$m.

In preparing the developing agent, inorganic fine particles such as fine hydrophobic silica powder mentioned earlier may be added to the developing agent prepared as described above in order to enhance the fluidity, preservability, developing property and transfer property of the developing agent. The externally added agent is mixed by using a generally employed powder mixer which is desirably provided with a jacket or the like to adjust the internal temperature. In order to change the hysteresis of load imparted to the externally added agent, the externally added agent may be added in the course of the process or gradually. It is, of course, allowable to change the rotational speed, rolling speed, time and temperature of the mixer. A large load may, first, be exerted and a relatively small load may, then, be exerted, or vice versa.

The mixing facility that can be used may be a V-type mixer, locking mixer, Redige mixer, Nanter mixer or Henschel's mixer.

(full-color image Developing)

A nonmagnetic one-component full-color process is conducted according to the nonmagnetic one-component developing system using the electrically conducting brush of the invention, by successively effecting the development many times by using a full-color toner having a particular circularity and transferring the image onto the transfer medium so as to be overlapped successively. In particular, a half-tone is uniformly reproduced.

The full-color nonmagnetic one-component image formation process of the invention successively develops the electrostatic latent images formed in many colors on the photosensitive material by the electrically conducting brush charger and exposure device by using developing agents corresponding to the colors and transfers them onto a transfer medium by using a plurality of multi-color developing devices having a developing roller and a developing blade for uniformly limiting the thickness of the layer of the developing agent fed onto the developing roller.

Further, the full-color nonmagnetic one-component image formation process of the invention successively develops the electrostatic latent images formed in many colors on a plurality of photosensitive materials corresponding to the colors by the electrically conducting brush charger and exposure device by using developing agents corresponding to the colors and transfers them onto a transfer medium by using a plurality of multi-color developing devices having a developing roller and a developing blade for uniformly limiting the thickness of the layer of the developing agent fed onto the developing roller.

In this case, it is desired to effect the development by the reversal developing system in which the electrostatic latent image on the photosensitive material has the same polarity as the polarity of the nonmagnetic one-component developing agent.

It is further desired to effect the development by rotating the developing roller at a speed higher than the photosensitive material by bringing the electrostatic latent image on the photosensitive material into direct contact with the developing roller.

EXAMPLES

Described below is an example in which the image formation process according to the present invention is adapted to a full-color electrophotographic printer. It need not be pointed out that the image formation process of the invention is not limited to this example.

Figure 3:
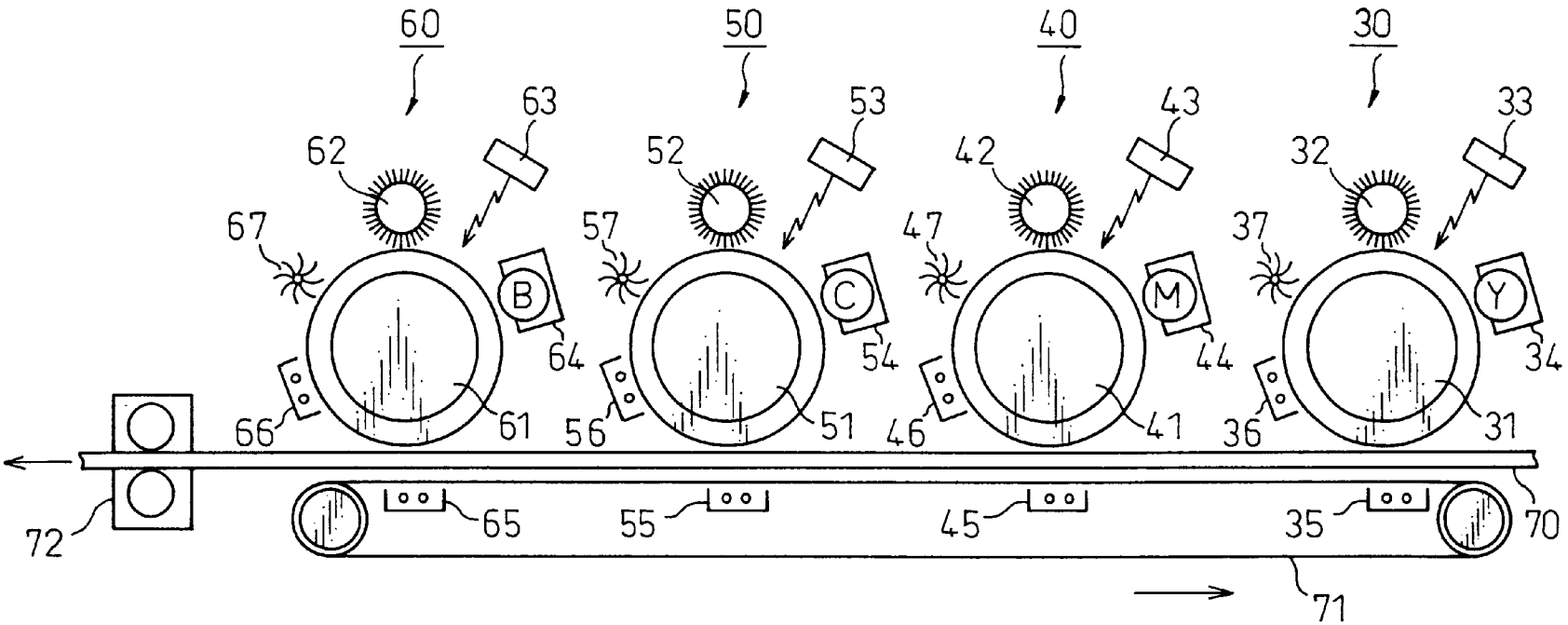
FIG. 3 is a sectional view roughly illustrating an electrophotographic full-color printer used for putting the present invention into practice.

FIG. 3 illustrates a full-color tandem electrophotographic printer. Image-forming units 30, 40, 50 and 60 for forming monochromatic images of yellow, magenta, cyan and black are arranged in a direction in which a paper 70 is conveyed (see an arrow). The image-forming units are each constituted by an electrically conducting brush charger for imparting electric charge onto the surface of a photosensitive material drum, an exposure device for forming a latent image, a developing device for forming a toner image by visualizing the latent image with a developing agent, a transfer device for transferring the visualized toner image onto a paper which is an image-recording medium, a charge-removing device for removing electric charges remaining on the surface of the photosensitive material drum, and a cleaning device for removing the toner remaining on the photosensitive material drum after the toner image has been transferred, with the photosensitive material drum as a center. For example, the yellow image-forming unit 30 is constituted by an electrically conducting brush charger 32, an exposure device 33, a developing device 34, an image transfer device 35, a charge-removing device 36 and a cleaning device 37 with a photosensitive material drum 31 as a center. The magenta image-forming unit 40, cyan image-forming unit 50 and black image-forming unit 60, too, are constituted in the same manner as the yellow image-forming unit 30 as shown. A transfer belt 71 is a semiconductor dielectric belt that is capable of moving in the direction of an arrow, and electrostatically adsorbs the paper 70 to convey it. Yellow, magenta, cyan and black toner images are melt-adhered onto the paper 70 by an image-fixing device 72 to obtain a desired full-color image.

Described below is an electrically conducting brush charger employed by the diagramed image-forming unit. As described earlier, the charging systems of the electrically conducting brush charger can be classified into those of the brush rotation type in which the roller-like brush is rotated to effect the electric charging and those of the fixed brush type in which the electric charging is effected by using a fixed plate-like electrically conducting brush. The diagramed example uses the roller-like electrically conducting brush charger capable of effecting the electric charging more uniformly.

The electrically conducting brush charger used in this example has a structure same as the one described above with reference to FIG. 1. That is, the electrically conducting brush 2 is fabricated by winding a brush of an electrically conducting fiber 5 that is pile-woven around a stainless steel rod (core rod) 6 of a diameter of 5 mm, cutting the fiber length into 6 mm, and laying the ends of the fiber to obtain a rotor of a diameter of 15 mm. The electrically conducting property is imparted by uniformly dispersing carbon particles in the fiber. Here, the thickness of the rayon fiber that is used is, preferably, from 400 to 800 deniers (444.4 to 888.8 decitexes)/100 F and, more preferably, 600 deniers (666.6 decitexes)/100 F. Further, the fiber density on the base fabric is, preferably, 50,000 to 150,000 (weight per 100 filaments) and 100,000 F/in$^2$ (number of filaments per a square inch=6.45 cm$^2$). The electric resistance of the brush fiber will be described later. As for the positional relationship between the electrically conducting brush and the photosensitive material drum 1 which is the image carrier, the electrically conducting core rod 6 is in parallel with the photosensitive material drum 1, and the electrically conducting brush 2 comes into contact with the surface of the photosensitive material drum 1 biting into a depth of about 1.0 mm.

To electrically charge the photosensitive material drum 1, the drum 1 is rotated at a predetermined peripheral velocity, and the brush 2 is rotated at a peripheral velocity 1.6 times as fast as that of the drum 1. A voltage is applied to the rotary brush 2 from a power source 3 to electrically charge the surface of the drum 1 to a predetermined potential. Here, the power source 3 is capable of applying a voltage obtained by overlapping an AC component and a DC component upon one another and is, concretely, capable of applying a DC=−650 V and an AC=1,100 V, giving a photosensitive material charging potential of −650 V which is necessary for the recording process.

The developing device employed for the diagramed image-forming unit has a structure the same as the one described above with reference to FIG. 2. That is, the developing device 10 is defined by a casing having an opening which faces the surface of the photosensitive material drum 1, and includes a toner container 13 for containing the nonmagnetic one-component developing agent (hereinafter referred to as "toner") 11, a developing roller 14 which is partly exposed through the opening of the toner container 13 and rotates at a predetermined peripheral velocity in the direction of an arrow (counterclockwise direction), a toner replenishing roll (sponge roller) 15 which rotates in the direction of an arrow (counterclockwise direction) in pressure contact with the developing roller 14 on the right side thereof, and a toner layer thickness-limiting blade (usually called doctor blade ) 16 which is a member for uniformly limiting the thickness of the toner layer on the developing roller 14 conveyed onto the developing region facing the photosensitive material drum 1 accompanying the rotation of the developing roller 14. The right upper portion in the toner container 13 works as a developing agent storage means and is called a hopper portion. Though not diagramed, the toner container 13 may contain an agitator for feeding the toner 11 onto the surface of the toner replenishing roll 15 and for agitating the toner in the hopper.

The developing roller 14 may be so disposed as to execute the noncontact developing facing the surface of the photosensitive material drum 1 maintaining a predetermined gap in the developing region as shown, or may be so disposed that the toner layer on the developing roller 14 comes into contact with the surface of the photosensitive material drum 1 to execute the contact development. In the contact development, however, when the developing is effected at almost the same velocity, the toner may physically adhere despite of a potential on the surface of the photosensitive material drum 1 since there is no difference in the velocity between the surface of the photosensitive material drum 1 and the surface of the developing roller 14. To prevent this, it is desired to set the peripheral velocity of the developing roller 14 to be slightly faster than the peripheral velocity of the photosensitive material drum 1. It is desired that the peripheral velocity ratio (peripheral velocity of the photosensitive material drum:peripheral velocity of the developing roller) is from 1:1.1 to 1:1.5.

To the developing roller 14 is applied a suitable developing bias voltage such as a direct current, an alternating current, an alternating current on which a direct current is superposed, or a pulse voltage from the bias power source 17. In the case of a noncontact developed image, in particular, it is desired to apply a voltage (alternating current, alternating current on which a direct current is superposed, or a pulse voltage) having an AC component of good jumping condition. In this example, there is used a developing roller 14 made of an electrically conducting rubber having a resistance of $10^5$ Ω to $10^8$ Ω in terms of shaft-surface resistance.

The toner replenishing roll 15 has a layer of an elastic foamed material on a core metal. Numerous voids are formed in at least the surface of the layer of the elastic foamed material to hold the toner therein. It is desireable that the layer of the elastic foamed material of the toner replenishing roll 15 is the one which lies on an intermediate position, in a frictional charge series, between the material of the toner 11 and the material on the surface of the developing roller 14 so as to impart a desired frictional charge to the toner 11 and to the developing roller 14 upon coming in contact with the developing roller 14. The toner replenishing roll 15 is supported at a position where it comes into contact with the surface of the developing roller 14 while biting it to a predetermined depth, and is so driven as to rotate in the forward direction in which the surface of the developing roller 14 moves at a portion contacting to the developing roller 14. It is desired to so set the linear velocity of the toner replenishing roll 15 to be 0.9 to 1.1 times as great as the linear velocity of the developing roller 14 and, preferably, to be equal to the linear velocity of the developing roller 14. This is to prevent the toner from being deteriorated by the mechanical friction. Upon setting the linear velocities to be equal, the toner is least deteriorated. By selecting the diameter of the toner replenishing roll 15 to be smaller than the diameter of the developing roller 14, further, the nipping width can be decreased and the mechanical friction can be minimized to further suppress the deterioration of the toner.

The present inventors have attempted to decrease the background fogging caused by a fouled brush, in the electrically conducting brush charger, by preparing such a toner that the externally added agent hardly peels off the toner, the toner being used as a developing agent in the image formation process that was described above in detail. To measure the peeling degree of the externally added agent, there is employed "externally added agent freeing ratio (%)" that can be measured by the method of measuring the externally added agent freeing ratio described below.

There was provided a Coulter counter TAII having an aperture diameter of 100 μm (manufactured by Coulter Co.) to measure the distribution of toner particle diameters. The theoretical number of the externally added agent particles per a toner particle was calculated from the distribution of the particle diameters, recipe of the externally added agent and the true specific gravity. On the other hand, the sample toner was observed through an electron microscope to count the number of the externally added agent particles (measured number of the externally added agent particles) adhered to the sample toner. At the same time, the diameters of the externally added agent particles were measured from the image of the electron microscope, and an average particle diameter was calculated therefrom. The numerical values of the two were substituted for the following formula to calculate a desired externally added agent freeing ratio.

In the following formula, the particle number of the measured externally added agent particles is doubled since the back of the image of the electronic microscope is counted at the same probability. The theoretical particle number of the externally added agent particles was calculated assuming that the toner has a true specific gravity ρt, a toner average particle diameter is D, the externally added agent has a true specific gravity ρa, and the externally added agent has an average particle diameter d when the externally added agent is added in an amount of a parts per 100 parts of the toner. That is, the theoretical particle number of the externally added agent particles per one toner particle was calculated by the formula: $na/nt=(a/100)\times(\rho t/\rho a)\times(D/d)^3$.

$$\text{Externally added agent freeing ratio (\%)} = 100 - \frac{(\text{measured number of the externally added agent particles})\times 2}{(\text{theoretical particle number of the externally added agent particles per a toner particle})\times(\text{measured particle number of the toner particles})}$$

Note, the externally added agent freeing ratio found as described above will be described in Table 2 appearing later.

Next, the image formation process according to the present invention will be described by way of working examples. It should, however, be noted that the invention is in no way limited to these examples only. In the examples, parts and "%" are all by weight unless stated otherwise.

Example 1

Preparation of toners A to K.

Eleven kinds of toners (using different externally added agents) were prepared according to the following recipe and method.

Preparation of mother toner I:

A mother toner I which is a mother member for preparing various toners, was prepared according to the following procedure.

| | |
|---|---|
| Polyester resin 1 (acid value = 5, Mn = 4500, Mw/Mn = 4.0, Tg = 60° C.) | 700 parts |
| Pigment (Lionol Blue FG – 7351, manufactured by Toyo Ink Co.) | 300 parts |

The above starting materials were mixed well using the Henschel's mixer, 3-pass melt-kneaded using a three-roll mill, and the kneaded product was rolled and cooled. Thereafter, the kneaded product was pulverized using a pulverizer to obtain a master batch pigment.

Then, the mother toner I was prepared from the master batch pigment that was obtained.

| | |
|---|---|
| Polyester resin 1 (acid value = 5, Mn = 4500, Mw/Mn = 4.0, Tg = 60° C.) | 100 parts |
| Master batch pigment | 10 parts |
| Zinc salicylate | 4 parts |

The above starting materials were mixed well using the Henschel s mixer, melt-kneaded using a biaxial extruder/kneader, and the kneaded product was rolled and cooled. The kneaded product was then pulverized by using a pulverizer (I-type mill, manufactured by Nihon Pneumatic Kogyo Co.) of the collision plate type based on a jet mill and was pneumatically classified by a whirling stream (DS Classifier, manufactured by Nihon Pneumatic Kogyo Co.) to obtain the mother toner I having a volume average particle diameter of 9.1 μm. The amount of charge of the mother toner I was −25 μC/g.

Preparation of mother toner II:

A mother toner II which is a mother member for preparing various toners, was prepared according to the following procedure.

| | |
|---|---|
| Styrene/butyl acrylate copolymer resin (Styrene/n-Ba = 82/18, Mn = 7400, Mw/Mn = 39, Tg = 63° C.) | 85 parts |
| Carbon black (trade name "MA60", manufactured by Mitsubishi Kagaku Co.) | 10 parts |
| Charge control agent (chrome-containing monoazo dye, trade name "Bontron S34", manufactured by Orient Kagaku Co.) | 3 parts |
| Carnauba wax (ester wax, m.p. = about 82° C.) | 2 parts |

The above starting materials were mixed well using the Henschel's mixer, melt-kneaded using a biaxial extruder/kneader, and the kneaded product was rolled and cooled. The kneaded product was then pulverized by using a pulverizer (I-type mill, manufactured by Nihon Pneumatic Kogyo Co.) of the collision plate type based on a jet mill and was pneumatically classified by a whirling stream (DS Classifier, manufactured by Nihon Pneumatic Kogyo Co.) to obtain the mother toner II having a volume average particle diameter of 8.9 μm. The amount of charge of the mother toner II was −18 μC/g.

Preparation of the toners A to K:

Eleven kinds of the toners were prepared by using the mother toner I or II prepared as described above, and changing the particle diameter, kind and the mixing condition of the externally added agent.

(1) Toner A

| | |
|---|---|
| Mother toner I | 100 parts |
| Hydrophobic silica of small particle diameter (trade name "R972D" manufactured by Nihon Aerosil Co.) | 1 part |
| Externally added agent of MMA-nBA copolymer (methyl methacrylate/butyl acrylate copolymer, particle diameter = 0.5 μm, amount of electric charge = +150 μC/g) | 0.5 parts |

The above starting materials were mixed together for 10 minutes using the Henschel's mixer. The mixture was then sifted with air to obtain a toner A.

(2) Toners B, C, D and E

Toners B, C, D and E were prepared in the same manner as the toner A. Here, however, the MMA-nBA copolymer that. was added as the externally added agent was changed for its particle diameter as follows depending upon the toners B to E:

Toner B: particle diameter, 0.05 μm

Toner C: particle diameter, 0.15 μm

Toner D: particle diameter, 1.5 μm

Toner E: particle diameter, 2.5 μm (3) Toner F

| | |
|---|---|
| Mother toner II | 100 parts |
| Hydrophobic silica of small particle diameter (trade name "R972D" manufactured by Nihon Aerosil Co.) | 1 part |
| Externally added agent of MMA-nBA copolymer (particle diameter = 0.15 μm, amount of electric charge = +150 μC/g) | 0.5 parts |

The above starting materials were mixed together for 10 minutes using the Henschel's mixer in the same manner as the preparation of the toner A. The mixture was then sifted with the air to obtain a toner F.

(4) Toner G

| | |
|---|---|
| Mother toner I | 100 parts |
| Hydrophobic silica of small particle diameter (trade name "R972D" manufactured by Nihon Aerosil Co.) | 1 part |

-continued

| | |
|---|---|
| Externally added agent of MMA-nBA copolymer (particle diameter = 0.5 μm, amount of electric charge = +150 μC/g) | 0.5 parts |

The above starting materials were mixed together for 3 minutes using the Henschel's mixer in the same manner as the preparation of the toner A. The mixture was then shifted with the air to obtain a toner G.

(5) Toner H

| | |
|---|---|
| Mother toner I | 100 parts |
| Hydrophobic silica of small particle diameter (trade name "R972D" manufactured by Nihon Aerosil Co.) | 1 part |
| Externally added agent of MMA-nBA copolymer (particle diameter = 1.5 μm, amount of electric charge = +150 μC/g) | 0.5 parts |

The above starting materials were mixed together for 3 minutes using the Henschel's mixer in the same manner as the preparation of the toner A. The mixture was then sifted with the air to obtain a toner H.

(6) Toner I

| | |
|---|---|
| Mother toner I | 100 parts |
| Hydrophobic silica of small particle diameter (trade name "R972D" manufactured by Nihon Aerosil Co.) | 1 part |
| Externally added agent of melamine resin (particle diameter = 0.5 μm, amount of electric charge = +300 μC/g) | 0.5 parts |

The above starting materials were mixed together for 10 minutes using the Henschel's mixer in the same manner as the preparation of the toner A. The mixture was then sifted with the air to obtain a toner I.

(7) Toner J

| | |
|---|---|
| Mother toner I | 100 parts |
| Hydrophobic silica of small particle diameter (trade name "R972D" manufactured by Nihon Aerosil Co.) | 1 part |
| Externally added agent of PMMA resin (particle diameter = 0.5 μm, amount of electric charge = +100 μC/g) | 0.5 parts |

The above starting materials were mixed together for 10 minutes using the Henschel's mixer in the same manner as the preparation of the toner A. The mixture was then sifted with the air to obtain a toner J.

(8) Toner K

| | |
|---|---|
| Mother toner I | 100 parts |
| Hydrophobic silica of small particle diameter (trade name "R972D" manufactured by Nihon Aerosil Co.) | 1 part |
| Externally added agent of PTFE resin (particle diameter = 0.5 μm, amount of electric charge = −250 μC/g) | 0.5 parts |

The above starting materials were mixed together for 10 minutes using the Henschel's mixer in the same manner as the preparation of the toner A. The mixture was then sifted with the air to obtain a toner K.

Table 1 below shows the kinds of the mother toners, kinds, particle diameters and polarities of the externally added agents of large diameters and the mixing times for the eleven kinds of the toners A to K prepared as described above.

TABLE 1

| | Mother toner | Kind of ext. add. agent | Diameter of ext. add. agent (μm) | Palarity of ext. add. agent | Mixing time (min) |
|---|---|---|---|---|---|
| Toner A | I | MMA-nBA copolymer | 0.5 | + | 10 |
| Toner B | I | MMA-nBA copolymer | 0.05 | + | 10 |
| Toner C | I | MMA-nBA copolymer | 0.15 | + | 10 |
| Toner D | I | MMA-nBA copolymer | 1.5 | + | 10 |
| Toner E | I | MMA-nBA copolymer | 2.5 | + | 10 |
| Toner F | II | MMA-nBA copolymer | 0.5 | + | 10 |
| Toner G | I | MMA-nBA copolymer | 0.5 | + | 3 |
| Toner H | I | MMA-nBA copolymer | 1.5 | + | 3 |
| Toner I | I | melamine resin | 0.5 | + | 10 |
| Toner J | I | PMMA | 0.5 | + | 10 |
| Toner K | I | PTFE | 0.5 | − | 10 |

Example 2

Continuous running testing.

The toners A to K prepared according to Example 1 were mounted on the electrophotographic color printer described earlier with reference to FIG. 3 and the continuous running testing was conducted in order to compare fouling of the electrically conducting brush caused by the deposition of the externally added agent and to compare the background fogging caused by the fouled brush. Further, deterioration in the picture quality was judged, by eye, before and after the continuous running testing, and the freeing ratios of the externally added agents were also measured.

A voltage was applied to the toner replenishing roll and to the developing roller in the developing device arranged in each image-forming unit, and the drive portions of the printer were operated to continue the printing operation for more than 20 hours. In the case of this printer which is capable of printing 13 pieces of color copies a minute, about 20 hours are required for printing 15,000 pieces of copies. In order to prevent the consumption of toner in this experiment, no electrostatic latent image was given onto the photosensitive drum, i.e., the printing factor was set to be 0% such that no toner was replaced. As mentioned above, this is referred herein to as "no load operation" and is a method for accelerating the fouling of the brush. In addition to this method, the testing may be conducted by using any other method provided it makes it possible to compare the degree of fouling of the brush caused by the agent externally added to the toner.

The following Table 2 shows the results of the continuous running testing conducted as described above. In Table 2, the results of measurement were evaluated in three steps, ○ representing "good", Δ representing "acceptable" and X representing "bad".

TABLE 2

| | Initial free rate | Free rate after 20 hrs. | Brush fouling after 20 hrs. | Background fogging after 20 hrs. | Image |
|---|---|---|---|---|---|
| Toner A | 10 | 25 | ○ | ○ | ○ |
| Toner B | 5 | 15 | ○ | ○ | X (reduction of granulality) |
| Toner C | 7 | 20 | ○ | ○ | Δ |
| Toner D | 17 | 35 | Δ | ○ | ○ |
| Toner E | 25 | 44 | X | X | X |
| Toner F | 12 | 30 | ○ | ○ | ○ |
| Toner G | 15 | 45 | Δ | Δ | Δ |
| Toner H | 25 | 60 | X | X | X |
| Toner I | 7 | 15 | ○ | ○ | ○ |
| Toner J | 22 | 35 | ○ | ○ | Δ |
| Toner K | 13 | 30 | ○ | ○ | ○ |

As will be understood from Table 2 above, good results are obtained concerning the freeing ratios of the externally added agent when the externally added agent has a average particle diameter of not larger than 0.1 μm. When the particle diameter is not larger than 0.1 μm, however, the picture quality is often deteriorated due to deterioration in the particle properties. It is therefore considered that the particle diameter of the externally added agent must not be smaller than 0.1 μm. When the particle diameter of the externally added agent is not smaller than 2.0 μm, however, the freeing ratio increases and the brush is fouled. It is therefore desired that the externally added agent has a particle diameter within a range of, preferably, from 0.1 to 2.0 μm and, more preferably, from 0.2 to 0.6 μm.

The present inventors have discovered the fact that to decrease the freeing ratio of the externally added agent, it is necessary to mix the mother toner and the externally added agent together to a sufficient degree. When they are not mixed well, the freeing ratio becomes high causing the brush to be fouled.

Further, when the charging polarity of the externally added agent is different from the charging polarity of the mother toner particles, the freeing ratio decreases. This is attributed to that the positive material and the negative material exhibit their attractive forces, and the externally added agent becomes less free than when they have the same polarity. It will be obvious that the same effect is obtained even when the mother toner particles have the positive polarity and the externally added agent has the negative polarity in addition to the case when the mother toner particles have the negative polarity and the externally added agent has the positive polarity which is the case in this example of the invention.

From the above results, therefore, fouling of the brush can be prevented by setting the initial freeing ratio of the externally added agent to be smaller than 20%. Upon suppressing the freeing ratio after 20 hours to be not larger than 40%, further, it is possible to prevent fouling to the brush and to prevent the resulting background fogging yet maintaining the life of the toner.

Example 3

Effect of the electrically conducting brush upon the brush fouling and upon the background fogging.

By giving attention to the electric resistance of the brush fiber, the present inventors have fabricated electrically conducting brushes A, B, C, d and E having different electric resistances in order to evaluate the effect of the electrically conducting brushes upon the brush fouling caused by the adhesion of the externally added agent and upon the background fogging. The brushes have the same structure as the one described earlier with reference to FIG. 1 and are of the roll type having a diameter of 15 mm obtained by winding an electrically conducting pile-woven rayon fiber of the form of a brush around an electrically conducting stainless steel rod having a diameter of 5 mm. In order to change the electric resistance of the brushes, further, the carbon particles were added at different ratios to the rayon fiber. The electric resistances of the electrically conducting brushes were measured by using a measuring jig that is schematically illustrated in FIG. 4 in a manner as described below.

Figure 4:
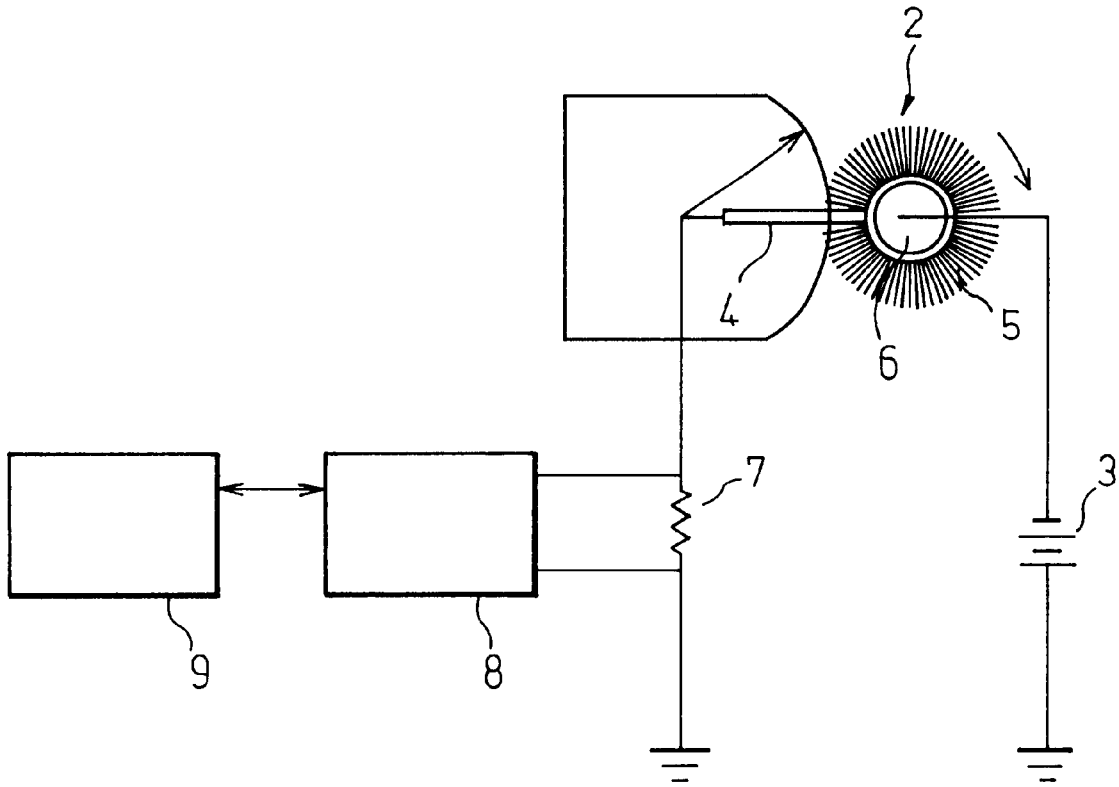
FIG. 4 is a diagram schematically illustrating the constitution of a measuring jig used for measuring the electric resistance of the electrically conducting brush.

The measuring jig shown in FIG. 4 is so constituted that the electrically conducting brush 2 obtained by winding the electrically conducting pile-woven rayon fiber of the form of a brush around the stainless steel rod 6, is rotated in contact with a measuring electrode 4 at a peripheral velocity of 100 mm/s. A voltage of −100 V is applied to the brush 2 from the DC power source 3. A microammeter 7 having a resistance of 100 Ω is connected to the measuring electrode 4, and the electric resistance is calculated from a current that flows into the measuring electrode 4. To calculate the electric resistance, further, the microammeter 7 is connected to a digital waveform memory 8 and to a personal computer 9. The brushes 2 were measured for their electric resistances as shown in Table 3 below.

Then, as in Example 2, the toner A prepared in Example 1 was put to the continuous running testing to measure the brush fouling after 20 hours have passed and the background fogging after 20 hours have passed. The results of measurement were as shown in Table 3 below. The measured results were evaluated in three steps, ○ representing "good", Δrepresenting "acceptable" and X representing "bad".

TABLE 3

| Brush | Electric resistance (Ω) | Brush fouling after 20 hrs. | Background fogging after 20 hrs. | Others |
|---|---|---|---|---|
| A | $1 \times 10^2$ | ○ | ○ | Brush and drum burned due to brush leakage |
| B | $1 \times 10^3$ | ○ | ○ | |
| C | $1 \times 10^5$ | ○ | ○ | |
| D | $1 \times 10^7$ | Δ | ○ | |
| E | $1 \times 10^8$ | X | X | Charge potential dropped |

As will be understood from Table 3 above, favorable results are obtained when the electric resistance of the brush lies within a range of from $1\times10^3$ to $1\times10^7$ Ω and more favorable results are obtained particularly when the electric resistance of the brush lies within a range of from $1\times10^4$ to $1\times10^6$ Ω. When the electric resistance of the brush is low, an excess current flows from the brush into the photosensitive material drum, whereby the brush is burnt and the photosensitive material drum is burnt, too. When the electric resistance of the brush is high, on the other hand, the brush is fouled conspicuously giving rise to the occurrence of background fogging and a drop in the charge potential, making it difficult to obtain a proper charge potential.

The present inventors consider that the brush is hardly fouled when the electric resistance is low because the electric charge migrates smoothly when the electric resistance is small. When the electric resistance is large, on the other hand, the electric charge is maintained to adsorb fouling such as the externally added agent, promoting the fouling of the brush.

Example 4

Different monochromatic toners and color toners were prepared according to the following recipe and methods.

Preparation of the toner 1:

| | |
|---|---|
| Polyester resin (acid value 3, hydroxyl group value 25, Mn: 45,000, Mw/Mn: 10.0, Tg: 65° C.) | 100 parts |
| Phthalocyanine green | 2 parts |
| Carbon black (MA60 manufactured by Mitsubishi Kagaku Co.) | 10 parts |
| Charge control agent (chrome-containing monoaze dye) | 2 parts |

The above starting materials were mixed using a mixer, melt-kneaded using a two-roll mill, and the kneaded product was rolled and cooled. The kneaded product was then pulverized by using a pulverizer (I-type mill, manufactured by Nihon Pneumatic Kogyo Co.) of the collision plate type based on a jet mill and was pneumatically classified by a whirling stream (DS Classifier, manufactured by Nihon Pneumatic Kogyo Co.) to obtain the coloring particles. The obtained coloring powder was treated by a turbo mill (manufactured by Turbo Kogyo Co.) to adjust the shape of the particles. To the powder was added hydrophobic silica (H2000 manufactured by Clariant Japan Co.) in an amount of 0.5% by weight while being mixed using a mixer to obtain a toner. The toner possessed a circularity of 0.945, a volume average diameter of 12.3 μm, and contained the particles of not smaller than 12.7 μm in an amount of 2.1% by weight and the particles of not larger than 5 μm in an amount of 22 particle number (No.) %. This toner is denoted by T1.

Preparation of toner 2:

The toner was prepared in the same manner as in the preparation of toner 1 but using the charge control agent (chrome-containing monoazo dye) in an amount of 3 parts. The toner possessed a circularity of 0.958, a volume average diameter of 12.1 μm, and contained the particles of not smaller than 12.7 μm in an amount of 2.2% by weight and the particles of not larger than 5 μm in an amount of 23 particle No. %. This toner is denoted by T2.

Preparation of toner 3:

The same materials as those used in the preparation of the toner 1 were mixed using a mixer, melt-kneaded using a two-roll mill, and the kneaded product was rolled and cooled. The kneaded product was then pulverized by using a pulverizer (I-type mill, manufactured by Nihon Pneumatic Kogyo Co.) of the collision plate type based on a jet mill and was pneumatically classified by a whirling stream (DS Classifier, manufactured by Nihon Pneumatic Kogyo Co.) to obtain the coloring particles. Here, however, the pneumatic pressure was elevated during the pulverization. The obtained coloring powder was treated by a turbo mill (manufactured by Turbo Kogyo Co.) to adjust the shape of the particles. To the powder was added hydrophobic silica (H2000 manufactured by Clariant Japan Co.) in an amount of 0.5% by weight while being mixed using a mixer to obtain a toner. The toner possessed a circularity of 0.945, a volume average diameter of 8.5 μm, and contained the particles of not smaller than 12.7 μm in an amount of 0.5% by weight and the particles of not larger than 5 μm in an amount of 25 particle No. %. This toner is denoted by T3.

Preparation of toner 4:

The same materials as those used in the preparation of the toner 1 were mixed using a mixer, melt-kneaded using a two-roll mill, and the kneaded product was rolled and cooled. The kneaded product was then pulverized by using a pulverizer (I-type mill, manufactured by Nihon Pneumatic Kogyo Co.) of the collision plate type based on a jet mill and was pneumatically classified by a whirling stream (DS Classifier, manufactured by Nihon Pneumatic Kogyo Co.) to obtain the coloring particles. Here, however, the speed of the whirling stream was increased by widening the air introduction gap of the classifier. The obtained coloring powder was treated by a turbo mill (manufactured by Turbo Kogyo Co.) to adjust the shape of the particles. To the powder was added hydrophobic silica (H2000 manufactured by Clariant Japan Co.) in an amount of 0.5% by weight while being mixed using a mixer to obtain a toner. The toner possessed a circularity of 0.962, a volume average diameter of 8.3 μm, and contained the particles of not smaller than 12.7 μm in an amount of 1.8% by weight and the particles of not larger than 5 μm in an amount of 12 particle No. %. This toner is denoted by T4.

Preparation of toner 5:

The toner was obtained in the same manner as in the preparation of the toner 1 but eliminating the step of treatment using the turbo mill. The toner possessed a circularity of 0.910, a volume average diameter of 12.3 μm, and contained the particles of not smaller than 12.7 μm in an amount of 2.1% by weight and the particles of not larger than 5 μm in an amount of 26 particle No. %. This toner is denoted by RT1.

Preparation of toner 6:

The toner was obtained in the same manner as in the preparation of the toner 1 but the shape of the coloring particles was adjusted by increasing the rotational speed of the turbo mill. The toner possessed a circularity of 0.985, a volume average diameter of 11.7 μm, and contained the particles of not smaller than 12.7 μm in an amount of 2.4% by weight and the particles of not larger than 5 μm in an amount of 19 particle No. %. This toner is denoted by RT2.

Preparation of color toner 1:

| | |
|---|---|
| Water | 1200 parts |
| Water-containing phthalocyanine green cake (solid content, 30%) | 200 parts |
| Carbon black (MA60, manufactured by Mitsubishi Kagaku Co.) | 540 parts |

were stirred well using a flusher. A polyester resin (acid value 3, hydroxyl group value 25, Mn: 45000, Mw/Mn: 4.0, Tg: 60° C.) was added thereto in an amount of 1200 parts. The mixture was then kneaded at 150° C. for 30 minutes followed by the addition of 1000 parts of xylene. The mixture was then kneaded for another one hour. After water and xylene are removed, the mixture was rolled and cooled, and was pulverized by a pulverizer to obtain a master batch pigment.

| | |
|---|---|
| Polyester resin (acid value 3, hydroxyl group value 25, Mn: 45000, Mw/Mn: 4.0, Tg: 60° C.) | 100 parts |
| master batch, mentioned above | 5 parts |
| Charge control agent (Bontron E-84, manufactured by Orient Kagaku Co.) | 4 parts |

The above materials were mixed using a mixer, melt-kneaded using a two-roll mill, and the kneaded product was rolled and cooled. The kneaded product was then pulverized, classified and adjusted for its shape in the same manner as in Example 1 to obtain the coloring particles. Hydrophobic silica (H2000 manufactured by Clariant Japan Co.) was added thereto in an amount of 0.5% by weight while being mixed using a mixer to obtain a black toner. The toner possessed a circularity of 0.945, a volume average diameter of 13.5 μm, and contained the particles of not smaller than 12.7 μm in an amount of 3.1% by weight and the particles of not larger than 5 μm in an amount of 22 particle No. %. This toner is denoted by BK1.

| | |
|---|---|
| Water | 600 parts |
| Water-containing cake of pigment yellow 17 | 1200 parts |

The above materials were stirred well using a flusher. A polyester resin (acid value 3, hydroxyl group value 25, Mn: 45000, Mw/Mn: 4.0, Tg: 60° C.) was added thereto in an amount of 1200 parts. The mixture was then kneaded at 150° C. for 30 minutes followed by the addition of 1000 parts of xylene. The mixture was then kneaded for another one hour. After water and xylene were removed, the mixture was rolled and cooled, and was pulverized by a pulverizer, and was passed twice through the three-roll mill to obtain a master batch pigment.

| | |
|---|---|
| Polyester resin (acid value 3, hydroxyl group value 25, Mn: 45000, Mw/Mn: 4.0, Tg: 60° C.) | 100 parts |
| master batch, mentioned above | 5 parts |
| Charge control agent (Bontron E-84, manufactured by Orient Kagaku Co.) | 4 parts |

The above materials were mixed using a mixer, melt-kneaded using a two-roll mill, and the kneaded product was rolled and cooled. The kneaded product was then pulverized, classified and adjusted for its shape in the same manner as in the preparation of the developing agent BK1 to obtain the coloring particles. Hydrophobic silica (H2000 manufactured by Clariant Japan Co.) was added thereto in an amount of 0.5% by weight while being mixed using a mixer to obtain a yellow toner. The toner possessed a circularity of 0.947, a volume average diameter of 13.6 μm, and contained the particles of not smaller than 12.7 μm in an amount of 3.0% by weight and the particles of not larger than 5 μm in an amount of 20 particle No. %. This toner is denoted by Y1.

| | |
|---|---|
| Water | 600 parts |
| Water-containing cake of pigment red 57 (solid content, 50%) | 1200 parts |

The above materials were stirred well using a flusher. A polyester resin (acid value 3, hydroxyl group value 25, Mn: 45000, Mw/Mn: 4.0, Tg: 60° C.) was added thereto in an amount of 1200 parts. The mixture was then kneaded at 150° C. for 30 minutes followed by the addition of 1000 parts of xylene. The mixture was then kneaded for another one hour. After water and xylene were removed, the mixture was rolled and cooled, and was pulverized by a pulverizer, and was passed twice through the three-roll mill to obtain a master batch pigment.

| | |
|---|---|
| Polyester resin (acid value 3, hydroxyl group value 25, Mn: 45000, Mw/Mn: 4.0, Tg: 60° C.) | 100 parts |
| master batch, mentioned above | 5 parts |
| Charge control agent (Bontron E-84, manufactured by Orient Kagaku Co.) | 4 parts |

The above materials were mixed using a mixer, melt-kneaded using a two-roll mill, and the kneaded product was rolled and cooled. The kneaded product was then pulverized, classified and adjusted for its shape in the same manner as in the preparation of the developing agent BK1 to obtain the coloring particles. Hydrophobic silica (H2000 manufactured by Clariant Japan Co.) was added thereto in an amount of 0.5% by weight while being mixed using a mixer to obtain a magenta toner. The toner possessed a circularity of 0.950, a volume average diameter of 13.6 μm, and contained the particles of not smaller than 12.7 μm in an amount of 2.9% by weight and the particles of not larger than 5 μm in an amount of 26 particle No. %. This toner is denoted by M1.

| | |
|---|---|
| Water | 600 parts |
| Water-containing cake of pigment blue 15:3 (solid content, 50%) | 1200 parts |

The above materials were stirred well using a flusher. A polyester resin (acid value 3, hydroxyl group value 25, Mn: 45000, Mw/Mn: 4.0, Tg: 60 C) was added thereto in an amount of 1200 parts. The mixture was then kneaded at 150° C. for 30 minutes followed by the addition of 1000 parts of xylene. The mixture was the kneaded for one hour. After water and xylene were removed, the mixture was rolled and cooled, and was pulverized by a pulverizer, and was passed twice through the three-roll mill to obtain a master batch pigment.

| | |
|---|---|
| Polyester resin (acid value 3, hydroxyl group value 25, Mn: 45000, Mw/Mn: 4.0, Tg: 60° C.) | 100 parts |
| master batch, mentioned above | 3 parts |
| Charge control agent (Bontron E-84, manufactured by Orient Kagaku Co.) | 4 parts |

The above materials were mixed using a mixer, melt-kneaded using a two-roll mill, and the kneaded product was rolled and cooled. The kneaded product was then pulverized, classified and adjusted for its shape in the same manner as in the preparation of the developing agent BK1 to obtain the coloring particles. Hydrophobic silica (H2000 manufactured by Clariant Japan Co.) was added thereto in an amount of 0.5% by weight while being mixed using a mixer to obtain a cyan toner. The toner possessed a circularity of 0.956, a volume average diameter of 13.4 μm, and contained the particles of not smaller than 12.7 μm in an amount of 2.5% by weight and the particles of not larger than 5 μm in an amount of 28 particle No. %. This toner is denoted by C1.

Preparation of color toner 2:

Toners of four colors were obtained in the same manner as the preparation of the color toner 1 but eliminating the step of treatment using the turbo mill. The toners possessed circularities, volume average diameters (μm), contained particles of not smaller than 12.7 μm in amounts (% by weight) and contained particles of not larger than 5 μm in amounts (particle number %) as shown in Table 4 below.

TABLE 4

| Toner | Color | Circularity | Vol. ave. diameter | 12.7 μm or more | 5 μm or less |
|---|---|---|---|---|---|
| RK1 | black | 0.912 | 12.5 | 2.1 | 23 |
| RY1 | yellow | 0.910 | 12.5 | 2.2 | 20 |
| RM1 | magenta | 0.909 | 12.4 | 2.3 | 22 |
| RC1 | cyan | 0.910 | 12.6 | 2.0 | 24 |

Example 5

Machines for evaluating the toners

Figure 2:
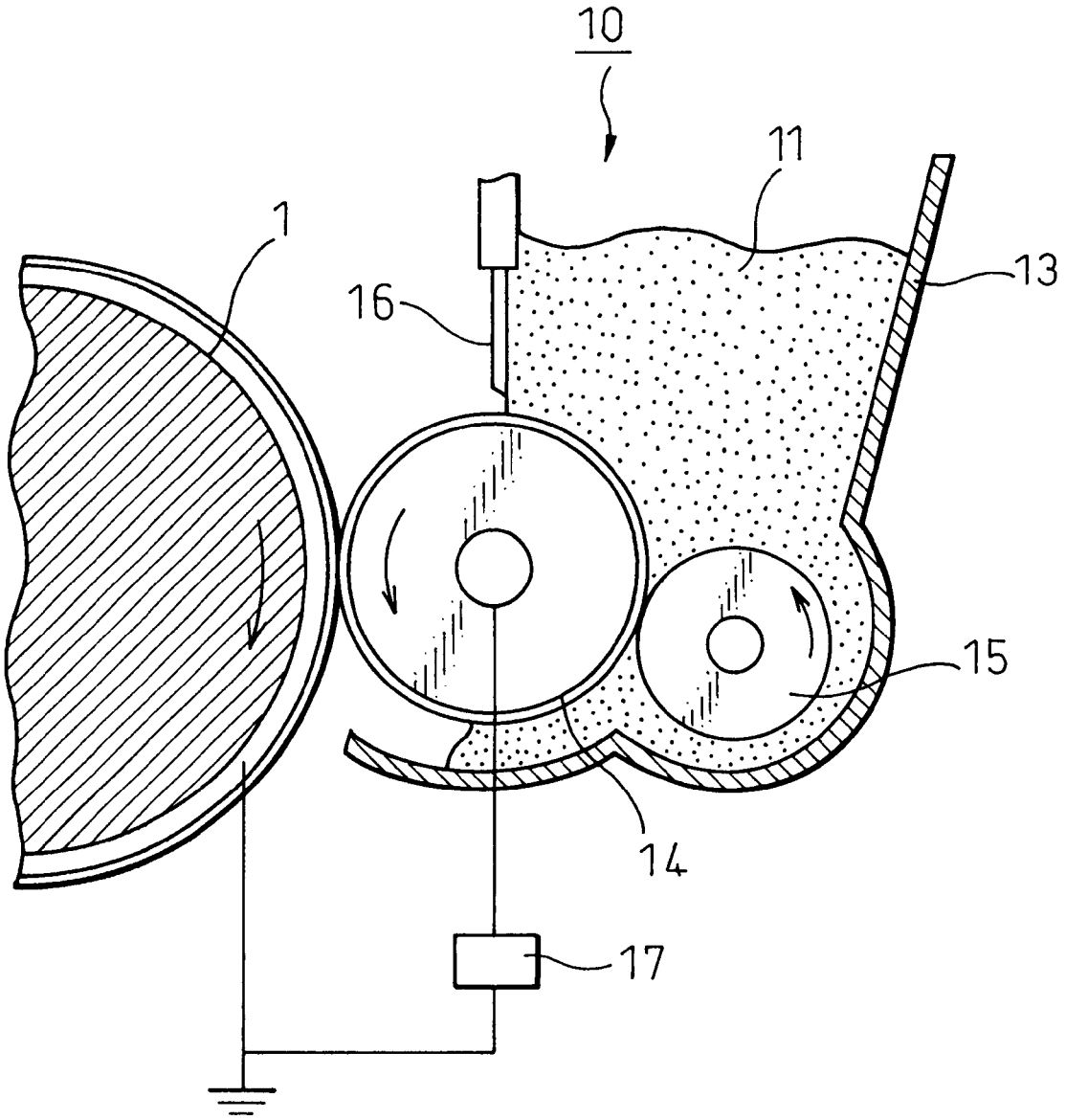
FIG. 2 is a sectional view schematically illustrating a developing device used in the present invention.

Printers shown in Table 5 below capable of adjusting the dot write diameter of laser beam, were provided having a unit that includes the charger of FIG. 1 equipped with an electrically conducting brush or a rayon fiber in which the carbon black is dispersed and having electrically conducting property as shown, having a photosensitive material and a nonmagnetic one-component developer with an elastic developing roller shown in FIG. 2.

TABLE 5

| Name of machine | Laser write diameter (μm) | Surface coarseness of developing roller (μm) | Fiber diameter of conducting brush (denier/100 F) | Fiber density of conducting brush (F/in$^2$) |
|---|---|---|---|---|
| A | 70 | 32 | 1000 | 30000 |
| B | 40 | 32 | 1000 | 30000 |
| C | 7 | 32 | 1000 | 30000 |
| D | 70 | 11 | 600 | 100000 |

Machine for evaluating the color toners

A tandem-type full-color printer was provided having four units for four colors, each unit including the charger having the electrically conducting brush, photosensitive material and non-magnetic one-component developer with an elastic developing roller like that of the machine A for evaluating a monochromic toner. The colors were successively printed onto the transfer paper in the order of yellow, magenta, cyan and black and were fixed at one time. The name of this evaluation machine is 4A.

Examples 6 to 14 and Comparative Examples 1 to 3

The testing was conducted for evaluating the following items 1) to 4) by using the toners prepared in Example 4 and using the evaluation machines provided in Example 5.

Items to be evaluated:

1) Amount of electric charge (Q/M) on the developing roller

The developing agent adhered on the developing roller during the developing of a solid image was sucked, and its amount of electric charge was measured using a Q-meter to find a ratio to the weight of the sucked developing agent. In the case of the full-color printing, this was effected for four colors to find an average value (unit in −μC/g).

2) Image density

After the solid image was output, the image density was measured by an X-Rite (manufactured by X-Rite Co.). In the case of the full-color printing, this was effected for four colors to find an average value.

3) Background fouling

White image was discontinued during the developing, the developing agent on the photosensitive material after developing was transferred onto a tape, and a difference of the image density of the tape from the non-transferred tape was measured using the X-Rite (manufactured by X-Rite Co.). In the case of the full-color printing, this was effected for four colors to find an average value.

4) Half-tone reproduceability

A continuous half-tone image comprising one-dot (full-dot) writing and a blank of one dot, was output, and the reproduceability of dot was compared with a sample of steps. Rank 1 is the lowest and rank 5 is the highest. In the case of the full-color printing, four colors were overlapped and evaluated.

Table 6 shows the results of evaluation.

TABLE 6

| | Toner | Machine | Q/M | Image density | Back-ground fouling | Half-tone reproduce-ability |
|---|---|---|---|---|---|---|
| Ex. 6 | T1 | A | 11 | 1.32 | 0.015 | 3 |
| Ex. 7 | T1 | B | 10 | 1.26 | 0.010 | 5 |
| Ex. 8 | T1 | C | 9 | 1.25 | 0.019 | 4 |
| Ex. 9 | T1 | D | 13 | 1.33 | 0.010 | 4.5 |
| Ex. 10 | T1 | A | 11 | 1.40 | 0.008 | 4.5 |
| Ex. 11 | T2 | A | 25 | 1.38 | 0.000 | 5 |
| Ex. 12 | T3 | A | 12 | 1.35 | 0.003 | 5 |
| Ex. 13 | T4 | A | 9 | 1.38 | 0.002 | 5 |
| Ex. 14 | YMCK1 | 4A | 45 | 1.85 | 0.005 | 5 |
| Comp. Ex. 1 | RT1 | A | 12 | 1.02 | 0.085 | 2 |
| Comp. Ex. 2 | RT2 | A | 11 | 1.51 | 0.125 | 2 |
| Comp. Ex. 3 | RYMCK1 | 4A | 48 | 1.65 | 0.032 | 3 |

What is claimed is:

1. An image formation process, wherein, in forming an electrostatic latent image according to an electrophotographic method and in forming a toner image by visualizing the electrostatic latent image with a developing agent, an electrically conducting brush is used as electric charging means, the brush, which is impressed with a voltage, is brought into contact with an image carrier to execute uniform electric charging, the electrostatic latent image is formed on the surface of the image carrier by the exposure to the image-bearing light, and the toner image is formed by a nonmagnetic one-component developing system using a developing agent of a toner having a circularity within a range of from 0.92 to 0.98.

2. An image formation process according to claim 1, wherein said image carrier is a photosensitive material, and the length of the short axis of an exposure spot on the photosensitive material is from 10 to 60 μm.

3. An image formation process according to claim 1, wherein said nonmagnetic one-component developing system is executed by using a developing device equipped with a developing roller and a developing blade which uniformly limits the thickness of the toner layer fed onto said developing roller.

4. An image formation process according to claim 1, wherein said electrically conducting brush is the one in which carbon black is dispersed in a fiber, the fiber having a diameter of from 400 to 800 deniers/100 F and having a density of from 50,000 to 150,000 F/in$^2$.

5. An image formation process according to claim 3, wherein the amount of electric charge of the toner on the developing roller is from 15 to 40 $\mu$C/g in terms of an absolute value.

6. An image formation process according to claim 1, wherein said toner has a volume average particle diameter of from 6 to 10 $\mu$m, and has such a particle diameter distribution that the particles of not smaller than 12.7 $\mu$m are contained in an amount of not larger than 1.0% by weight.

7. An image formation process according to claim 1, wherein said toner has a volume average particle diameter of from 6 to 10 $\mu$m, and has such a particle diameter distribution that the particles of not larger than 5 $\mu$m are contained in an amount of not larger than 15 particle number %.

8. An image formation process according to claim 1, wherein said toner is a color toner, and is used for the formation of a full-color image.

9. A developing agent for electrophotography comprising a toner having a circularity over a range of from 0.92 to 0.98, the developing agent for electrophotography being used in an image formation process which forms the toner image by the nonmagnetic one-component developing system by bringing an electrically conducting brush impressed with a voltage into contact with a photosensitive material, and forming an electrostatic latent image on the photosensitive material by the exposure to the image-bearing light.

10. A developing agent for electrophotography according to claim 9, wherein the amount of electric charge of the toner on the developing roller is from 15 to 40 $\mu$C/g in terms of an absolute value.

11. A developing agent for electrophotography according to claim 9, wherein said toner has a volume average particle diameter of from 6 to 10 $\mu$m, and has such a particle diameter distribution that the particles of not smaller than 12.7 $\mu$m are contained in an amount of not larger than 1.0% by weight.

12. A developing agent for electrophotography according to claim 9, wherein said toner has a volume average particle diameter of from 6 to 10 $\mu$m, and has such a particle diameter distribution that the particles of not larger than 5 $\mu$m are contained in an amount of not larger than 15 particle number %.

13. A developing agent for electrophotography according to claim 9, wherein said toner is a color toner.

14. An image formation process, wherein, in forming an electrostatic latent image according to an electrophotographic method and in forming a toner image by visualizing the electrostatic latent image with a developing agent, an electrically conducting brush is used as electric charging means, the brush which is impressed with a voltage is brought into contact with an image carrier to execute uniform-electric charging, the electrostatic latent image is formed on the surface of the image carrier by the exposure to the image-bearing light, and the toner image is formed by using a developing agent of a toner containing at least an externally added agent having an average particle diameter over a range of from 0.1 to 2.0 $\mu$m and a freeing ratio of not larger than 20%.

15. An image formation process according to claim 14, wherein said image carrier is a photosensitive material.

16. An image formation process according to claim 14, wherein the freeing ratio of said externally added agent is not larger than 40% as measured after the developing unit for forming the toner image by using the developing agent is operated with no load for 20 hours.

17. An image formation process according to claim 14, wherein the polarity of said externally added agent is different from the polarity of the mother toner particles constituting the developing agent.

18. An image formation process according to claim 14, wherein at least one kind of the externally added agents among the externally added agents included in the developing agent has an average particle diameter which is not smaller than 1/40 times of the average particle diameter of the toner constituting the developing agent.

19. An image formation process according to claim 14, wherein said electrically conducting brush has an electric resistance of from $1\times10^3$ to $1\times10^7$ $\Omega$.

20. An image formation process according to claim 14, wherein said toner is a color toner and is used for forming a full-color image.

21. A developing agent for electrophotography comprising a toner and containing at least an externally added agent having an average particle diameter over a range of from 0.1 to 2.0 $\mu$m and a freeing ratio of not larger than 20%, the developing agent for electrophotography being used in an image formation process which forms the toner image by the nonmagnetic one-component developing system by bringing an electrically conducting brush impressed with a voltage into contact with a photosensitive material, and forming an electrostatic latent image on the photosensitive material by exposure to the image-bearing light.

22. A developing agent for electrophotography according to claim 21, wherein the freeing ratio of said externally added agent is not larger than 40% as measured after the developing unit for forming the toner image by using the developing agent is operated with no load for 20 hours.

23. A developing agent for electrophotography according to claim 21, wherein the polarity of said externally added agent is different from the polarity of the mother toner particles constituting the developing agent.

24. A developing agent for electrophotography according to claim 21, wherein at least one kind of the externally added agents among the externally added agents included in the developing agent has an average particle diameter which is not smaller than 1/40 times of the average particle diameter of the toner constituting the developing agent.

25. A developing agent for electrophotography according to claim 21, wherein said toner is a color toner.

* * * * *